US006346866B2

(12) United States Patent
Nakakubo et al.

(10) Patent No.: US 6,346,866 B2
(45) **Date of Patent: *Feb. 12, 2002**

(54) DIELECTRIC LAMINATED DEVICE AND ITS MANUFACTURING METHOD

(75) Inventors: Hideaki Nakakubo, Kyoto; Toshio Ishizaki, Kobe; Toru Yamada, Katano; Hiroshi Kagata, Hirakata; Tatsuya Inoue, Takatsuki; Shoichi Kitazawa, Nishinomiya, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/440,238

(22) Filed: Nov. 15, 1999

Related U.S. Application Data

(62) Division of application No. 08/893,289, filed on Jul. 15, 1997, now Pat. No. 6,020,798.

(30) Foreign Application Priority Data

Jul. 15, 1996 (JP) ..... 8-184593

(51) Int. Cl.[7] ..... H01P 1/203; H01P 7/08
(52) U.S. Cl. ..... 333/204; 333/219
(58) Field of Search ..... 333/202, 203, 333/204, 205, 219, 238

(56) References Cited

U.S. PATENT DOCUMENTS

| | | | | |
|---|---|---|---|---|
| 5,160,905 A | | 11/1992 | Hoang | 333/204 |
| 5,396,201 A | | 3/1995 | Ishizaki et al. | 333/204 |
| 5,446,430 A | | 8/1995 | Yamanaka et al. | 333/202 |
| 5,479,141 A | | 12/1995 | Ishizaki et al. | 333/204 |
| 5,608,364 A | * | 3/1997 | Hirai et al. | 333/204 |
| 5,691,676 A | | 11/1997 | Snel et al. | 333/204 |
| 5,770,986 A | | 6/1998 | Tonegawa et al. | 333/204 |
| 5,898,403 A | | 4/1999 | Saitoh et al. | 343/700 MS |
| 5,963,115 A | | 10/1999 | Holleboom et al. | 333/204 |

FOREIGN PATENT DOCUMENTS

| | | |
|---|---|---|
| EP | 617478 | 9/1994 |
| JP | 60-248005 | 12/1985 |
| JP | 2-290303 | 11/1990 |
| JP | 5-315183 | 11/1993 |
| JP | 05327311 | 12/1993 |
| JP | 7-66078 | 3/1995 |
| JP | 07283626 | 10/1995 |
| JP | 8-265003 | 10/1996 |
| JP | 9-8514 | 1/1997 |

* cited by examiner

*Primary Examiner*—Robert Pascal
*Assistant Examiner*—Stephen E. Jones
(74) *Attorney, Agent, or Firm*—Ratner & Prestia

(57) ABSTRACT

By using a method for manufacturing a dielectric laminated. device, an opening is formed on a first dielectric sheet, a strip line and an input and output line including an input and output electrode are formed by burying electrode materials in said opening, the first dielectric sheet is laminated with the second and third dielectric sheets disposed above and below respectively to form a laminate, a first and second shield electrodes and a ground electrode are formed, an end of the strip line is connected to the ground electrode, the first shield electrode and the second shield electrode are mutually connected through the ground electrode, and the input and output electrode is exposed along the line direction of the strip line. By this constitution of the above dielectric laminated device, the mounting reliability of the dielectric laminated device can be further increased.

2 Claims, 21 Drawing Sheets

Press

Cutting

Press

Cutting

DIELECTRIC LAMINATED DEVICE AND ITS MANUFACTURING METHOD

This application is a division of U.S. patent application Ser. No. 08/893,289 filed Jul. 15, 1997, now U.S. Pat. No. 6,020,798. Issue Date Feb. 1, 2000.

BACKGROUND OF THE INVENTION

1. Field of the Invention

The present invention relates to a dielectric laminated device to be used for the high frequency wireless apparatuses such as portable telephones, and a manufacturing method thereof.

For example, the dielectric laminated resonator as a dielectric laminated device shown herein may be used solely as a resonator element for a high frequency oscillating circuit, and besides, the plural dielectric laminated resonators are used for combining to constitute a dielectric filter which operates as a band pass filter or a band elimination filter.

2. Description of the Related Art

In recent years, with the development of mobile communication, there have been strong demands for miniature portable telephone apparatuses which are convenient to carry with. Especially, because a dielectric filter using a dielectric laminated resonator is one of the most important parts of the high frequency parts to be used for the wireless circuit of the portable telephones, its formation into miniature size and high performance is strongly demanded.

Hereinafter, referring to the drawings, an example of the conventional dielectric laminated resonator as mentioned above is explained. FIG. 19 shows a disassembled perspective view of a conventional dielectric laminated resonator. FIG. 20 shows a sectional view of a plane including the line X–X' in FIG. 19. Further, FIG. 21 shows a sectional view of a plane including the line Y–Y' in FIG. 19.

In FIGS. 19, 20, and 21, a strip line 202 is formed on the first dielectric sheet 201, and the dielectric sheets 201 and 203 which are laminated on the upper and lower parts of the strip line 202, are put between the shield electrodes 204. By grounding an end of the strip line 202 through the grounding electrode 205, a tip short-circuited strip line resonator is constituted. With the frequency at which the length of the strip line becomes ¼ wavelength, the impedance at the open end becomes infinitive and parallel resonance occurs. The dielectric laminated resonator of such a structure is disclosed, for example, in Japanese Patent Laid-open No. H2-290303, FIG. 1.

However, according to the constitution as described above, it is possible to make the resonator thin and small size, but due to the formation of the strip line by screen printing, it is difficult to form the line thickness to more than 20 $\mu$m, and due to the formation of the convex part by forming a strip line on the dielectric sheet, the edge on the lateral side of the strip line crashes, leading to thinning of the line thickness on the lateral side part of the strip line. Accordingly, the high frequency current concentrates on the lateral side of the strip line, thereby providing the problems, such as enlargement of the conduction loss of the strip line and lowering of unloaded Q.

SUMMARY OF THE INVENTION

An object of the present invention is to provide a dielectric laminated device which can improve the reliability of mounting of the dielectric laminated device and its manufacturing method. Another object of the present invention is to provide a miniature, low cost dielectric laminated device while maintaining favorably the performance of the dielectric laminated device, and its manufacturing method.

In order to attain the above objects, a dielectric laminated device of the present invention comprises: a dielectric member including a low temperature sintering material; a strip line buried in said dielectric member; and an input and output electrode connected to said strip line and exposed to a surface along a line direction of said strip line out of outer surfaces of said dielectric member.

A dielectric laminated device of the present invention comprises: a dielectric member containing a low temperature sintering material; and a strip line buried in said dielectric member;

wherein the thickness or the width of said strip line being varied on the basis of a line direction of said strip line.

A dielectric laminated device of the present invention comprises: a dielectric member containing a low temperature sintering material; a plurality of strip lines buried in said dielectric member; a coupling electrode buried in said dielectric member on one or other side of said plurality of strip lines; and an input and output coupling electrode buried in said dielectric member on one or the other side of said plurality of strip lines, wherein a thickness of said strip line being larger than each thickness of said coupling electrode and said input and output coupling electrode.

A dielectric laminated device of the present invention comprises: a dielectric member formed by laminating a plurality of dielectric sheets, a shield electrode disposed on an outer surface of said dielectric member, a strip line formed by an electrode material buried in an inside of a part of said plural dielectric sheets, and an input and output electrode connected to said strip line, and exposed to a surface along a line direction of the strip line out of an outer surfaces of said dielectric member.

A dielectric laminated device of the present invention comprises: a dielectric member formed by laminating a plurality of dielectric sheets including a first, second and third dielectric sheets, a shield electrode disposed on an outer surface of said dielectric member, a first strip line formed by an electrode material buried in an inside of said first dielectric sheet, a second strip line formed by said. electrode material buried in an inside of said second dielectric sheet which is laminated on one of faces of said first dielectric sheet, and a third strip line formed by said electrode material buried in an inside of said third dielectric sheet which is laminated on the other face of said first dielectric sheet, wherein surfaces of said second and third strip lines are respectively in contact with a surface of said first strip line along a line direction of said first strip line, a length of said second and third strip lines is shorter than a length of said first strip line, an end of said first strip line is electrically opened along with an end of said second and third strip lines, and the other end of said first strip line is electrically connected to a ground electrode disposed outside said dielectric member.

A dielectric laminated filter of the present invention comprises: a first dielectric sheet having a plurality of openings, a plurality of strip lines formed by burying electrodes in said plural openings, a second dielectric sheet laminated on one surface of said first dielectric sheet, a third dielectric sheet laminated on the other surface of said first dielectric sheet, a coupling electrode internally laminated in said second dielectric sheet, for forming a coupling capacity with said plural strip lines, an input and output coupling electrode internally laminated in said third dielectric sheet, for forming an input and output capacity with said plural strip line, a first shield electrode provided on an upper surface of said second dielectric sheet, and a second shield electrode provided on a lower surface of said dielectric sheet, wherein an end of said plural strip lines is connected to a ground electrode, the other end of said plural strip lines is opened, and said first to third dielectric sheets are calcined in one piece by the use of the same ceramic material.

A method for manufacturing a dielectric laminated device of the present invention comprises: a step for forming an burying space for burying an electric conductive member in a dielectric sheet, an burying step for burying an electric conductive member in said burying space so as to form a strip line and an input and output electrode for connecting said strip line, and a lamination step for forming a laminate by laminating a single or plural other dielectric sheets on a dielectric sheet on which said strip line and said input and output electrode are formed, wherein said input and output electrode is produced in a manner to expose on a surface along a line direction of said strip line out of outer surfaces of the dielectric laminated device to be manufactured on the basis of said three steps.

A method for manufacturing a dielectric laminated device of the present invention comprises: a step for forming an burying space for burying electric conductive members in a plurality of dielectric sheets, a strip line forming step for forming a strip line by burying an electric conductive member in said burying space in one dielectric sheet out of said plural dielectric sheets, an input and output electrode forming step for forming an input and output electrode by burying a conductive member in said burying space of another dielectric sheet out of said plural dielectric sheets, and a laminating step for laminating dielectric sheets burying with said conductive members so as to connect said input and output electrode with said strip line, and forming a laminate by laminating a single or plurality of other dielectric sheets on said laminated dielectric sheets, wherein said input and output electrode is manufactured in a manner to be exposed to a surface lying along a line direction of said strip line out of outer surfaces of said laminate.

A method for manufacturing a dielectric laminated device of the present invention comprises: a step for forming an burying space for burying electric conductive members in a dielectric sheet, an burying step for burying an electric conductive member in said burying space to form a strip line, and a laminating step for forming a laminate by laminating a plurality of dielectric sheets on which said strip line is formed and other dielectric sheet, wherein, of the strip lines burying in each layer of said plural dielectric sheets, a line length of one strip line is longer than the line length of other strip lines.

As described above, according to the present invention, by burying an electrode in the opening of the dielectric sheet and forming a strip line and an input and output electrode, small sized, highly reliable dielectric laminated device and its manufacturing method can be realized while favorably maintaining the performance of the resonator.

DESCRIPTION OF REFERENCE NUMERALS

Figure 2:
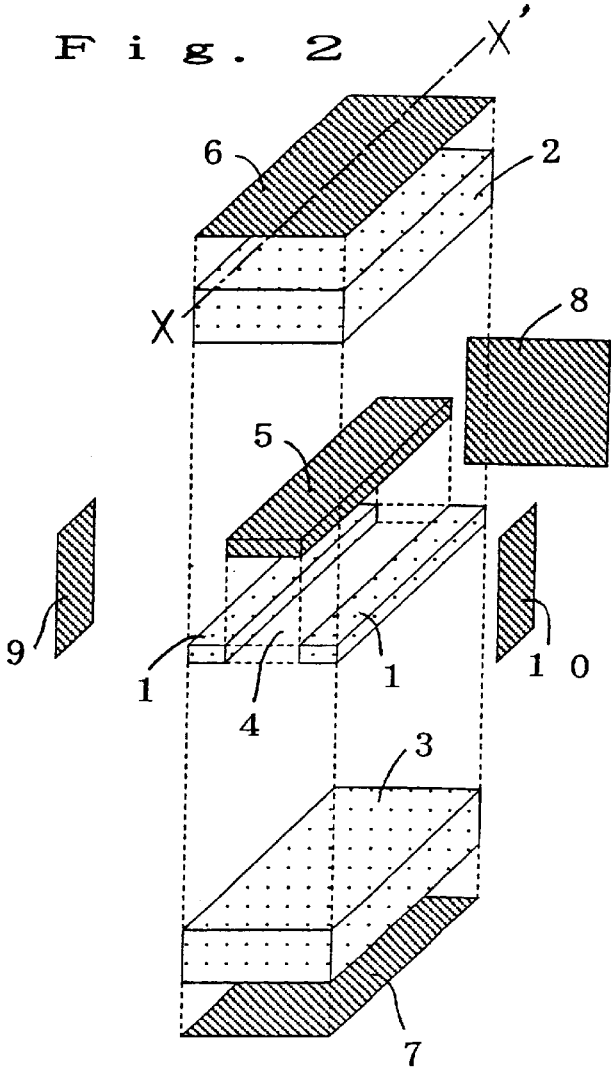
FIG. 2 is a disassembled perspective view of the dielectric laminated resonator in FIG. 1.

1 first dielectric sheet
2 second dielectric sheet
3 third dielectric sheet
4 opening
5 strip line
6 first shield electrode
7 second shield electrode
8 ground electrode
9, 10 side electrode
11 input and output electrode
12, 13 side shield electrode
21 through hole
22 through hole electrode
42 input and output line
49 strip line laminate
50 open end face

DESCRIPTION OF PREFERRED EMBODIMENTS

Hereinafter, preferred embodiments of the present invention will be explained with reference to the drawings.

Embodiment 1

Figure 1:
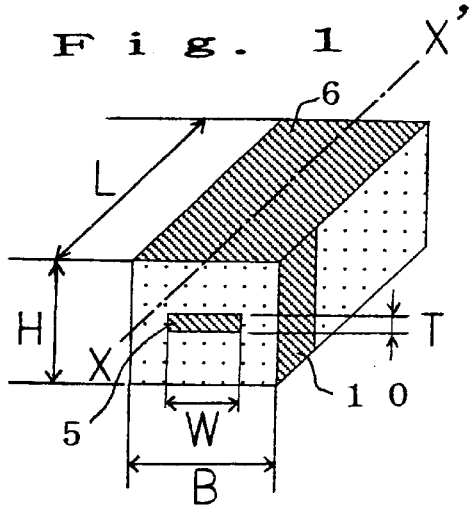
FIG. 1 is a perspective view of a dielectric laminated resonator in the first embodiment of the present invention.
Figure 3:
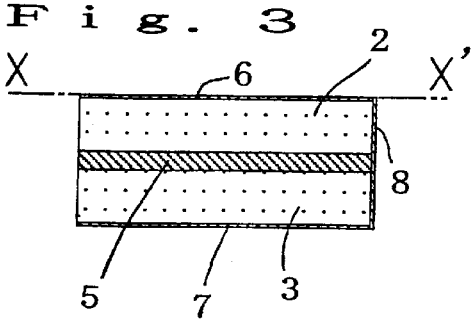
FIG. 3 is a sectional view of a plane including the line X–X' in FIG. 1.
Figure 34:
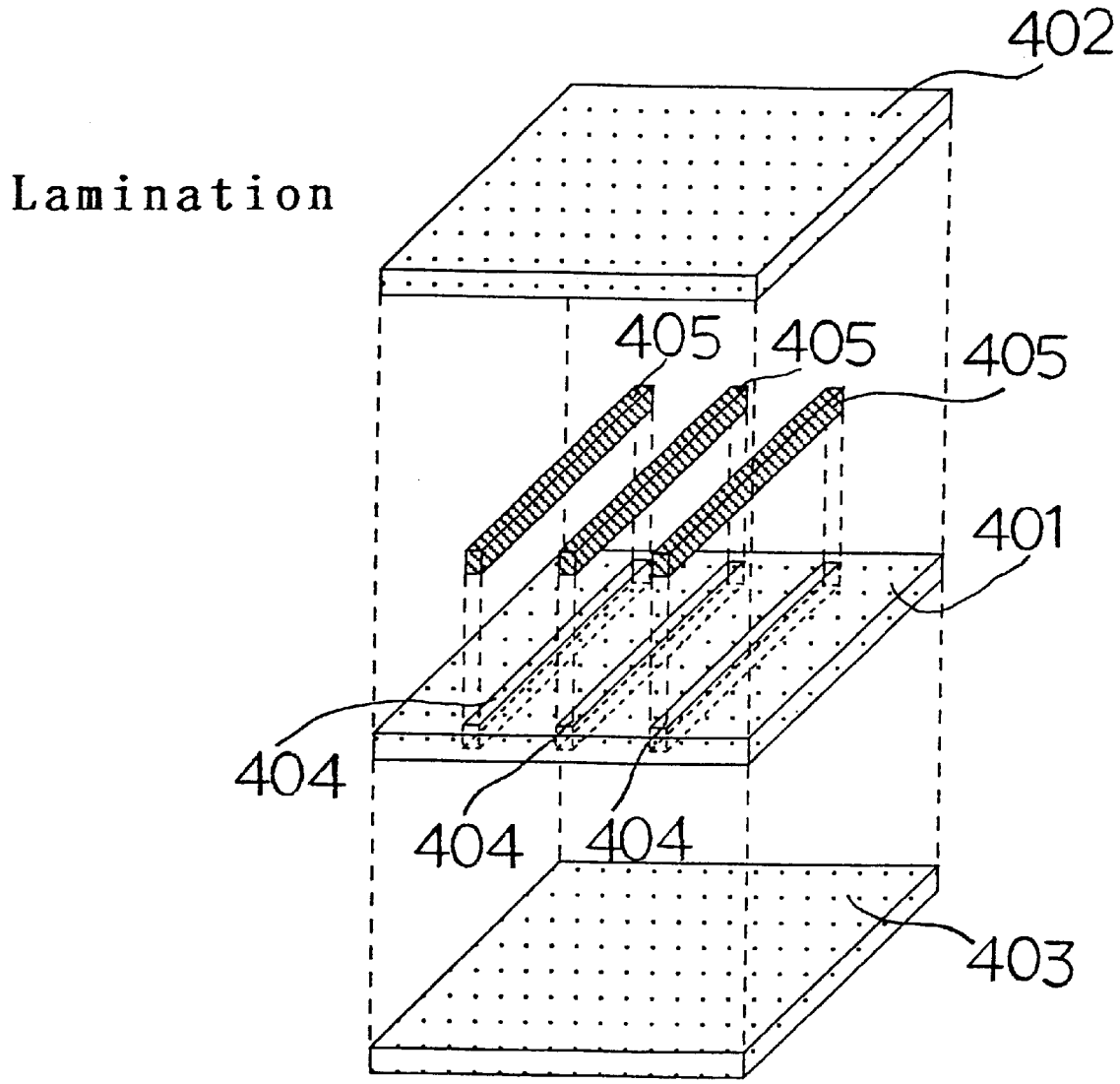
FIG. 34(A)–FIG. 34(C) are schematic views to illustrate the manufacturing steps of the dielectric laminated resonator in the first embodiment of the present invention.
Figure 34B:
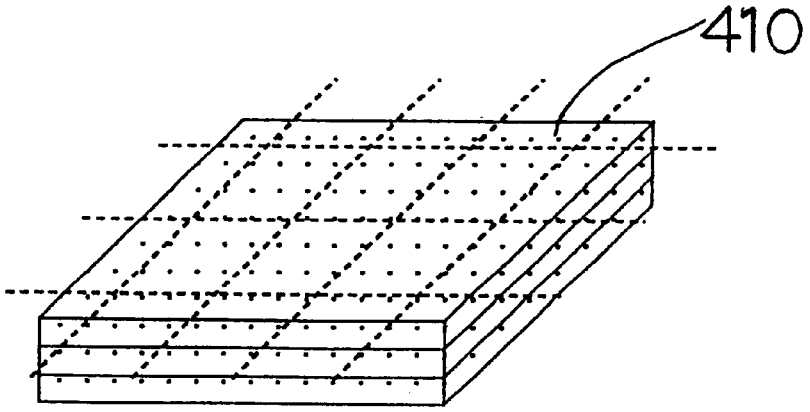
Figure 34C:
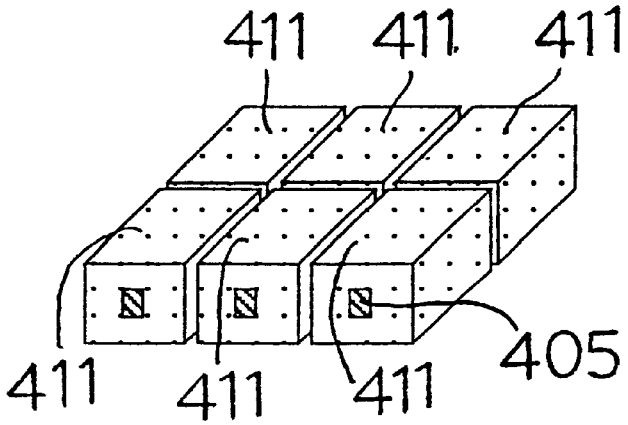

FIG. 1 is a perspective view of a dielectric laminated resonator in the first embodiment of the dielectric laminated device of the present invention. FIG. 2 is a disassembled perspective view in FIG. 1. Further, FIG. 3 is a sectional view of a plane including the line X–X' in,FIG. 1. FIG. 34(A)–FIG. 34(C) are schematic views to illustrate the manufacturing steps of the dielectric laminated resonator in this embodiment.

Here, in the first place, referring to FIG. 34(A)–FIG. 34(C), an outline of the manufacturing steps of the dielectric laminated resonator of this embodiment is described, and then, while explaining the details thereof, the constitution of said dielectric laminated resonator is simultaneously explained.

Namely, as shown in FIG. 34(A), the dielectric sheet 401 has plural openings 404 formed by punching with a puncher or a punching mold.

The dielectric sheet 401 is laminated with the dielectric sheet 403 which is disposed underneath, and an electrode material such as a silver paste or a metal plate is imbedded (buried) in the opening part 404 to form a strip-line 405, which is then laminated with the dielectric sheet 402 disposed above the dielectric sheet 401.

Thereafter, as shown in FIG. 34(B), the laminate 410 formed by laminating the dielectric sheets 401, 402, and 403 is pressed, and further, as shown in FIG. 34(C), cut to a desired shape. At this time, the laminate 410 is cut so that the end part of the strip line 405 is exposed to both lateral sides of a cut piece 411.

Further, the cut piece 411 is calcined at a temperature no more than 960° C. which is a melting point of silver, and after calcining, an external electrode is printed.

With respect to the dielectric laminated resonator made by the manufacturing step as above, while referring to FIG. 1–FIG. 3, further details of the manufacturing process are explained, and at the same time the constitution of the dielectric laminated resonator is described.

In FIG. 1, FIG. 2 and FIG. 3, the part 1 is a first dielectric sheet, 2 is a second dielectric sheet, and 3 is a third dielectric sheet. For these dielectric sheets there is used a low temperature sintered dielectric ceramic of green sheet form having a thickness of more than 40 $\mu$m.

The first dielectric sheet 1 has an opening (i.e., punched hole) 4. This opening 4 is a space of rectangular parallelepiped formed by punching with a puncher or a punching mold. The opening 4 is formed in a form to extend from one lateral side of the first dielectric sheet 1 to the other opposite lateral side, and both end faces thereof (i.e., sections) are formed in a manner to be disposed at the central parts of said one lateral side and the other lateral side.

The second dielectric sheet 2 and the third dielectric sheet 3 are formed in the same thickness.

The first dielectric sheet 1 is laminated with the third dielectric sheet 3 which is disposed underneath, and an electrode material such as a silver paste or a metal plate is imbedded in the opening part 4 to form a strip line 5 of rectangular parallelepiped, which is then laminated with the second dielectric sheet 2 disposed above the first dielectric sheet 1.

A laminate formed by laminating the dielectric sheets 1, 2 and 3 is pressed, and each dielectric sheet 1, 2 and 3 and the strip line 5 which is an internal electrode are simultaneously calcined at a temperature of no more than 960° C. which is a melting point of silver.

Also, on the whole upper surface of the laminate calcined as above, namely, on the whole upper surface of the second dielectric sheet 2, the first shield electrode 6 is formed as an external electrode by means of screen printing or the like using an electrode material such as a silver paste.

Also, on the whole lower surface of the laminate calcined as above, namely, on the whole lower surface of the third dielectric sheet 3, the second shield electrode 7 is formed as an external electrode by the similar means to that used in the first shield electrode 6.

Further, in the calcined laminate, on a lateral side crossing at an orthogonal direction with the line length direction of the strip line 5, a ground electrode 8 is formed as an external electrode by the same means as that of the first shield electrode 6, and the lateral side electrodes 9, 10 are formed on both lateral sides crossing at an orthogonal direction with the width direction of the strip line 5, in a band form.

In addition, an end of the strip line 5 is connected to the ground electrode 8, and the other end is used as an input and output electrode. The first shield electrode 6 and the second shield electrode 7 are mutually connected through the ground electrode 8 and lateral side electrodes 9, 10.

With respect to the dielectric laminated resonator manufactured and constituted in the above manner, the operation is then explained.

By grounding an end of the strip line 5 through the ground electrode 8, an end short-circuited strip line resonator is constituted. The impedance at the other end (open end) becomes infinite at the other end (open end) of the strip line at the frequency at which the length of the strip line becomes ¼ wavelength and the resonator shows parallel resonance.

Figure 4:
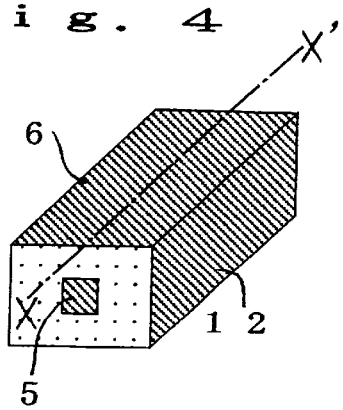
FIG. 4 is a perspective view of a dielectric laminated resonator in the second embodiment of the present invention.

The dielectric resonator having such structure and manufacturing process is shown, for example, in FIG. 4 which is disclosed in Japanese Patent Laid-open No. H5-315183 FIG. 4, in FIG. 3 which is disclosed in Japanese Patent Laid-open, No. H7-66078, in FIG. 1 which is disclosed in Japanese Patent Laid-open No. H9-8514, and the like.

However, according to the present embodiment, by imbedding the electrode in the opening 4 area of the dielectric sheet to form a rectangular parallelepiped strip line 5, the line thickness of the strip line can be increased to about 1 mm. This means that the line thickness can be made thicker than in the case of forming the line by screen printing. And, as it is possible to thicken the line in the small manufacturing steps, the desired size and shape of strip line can be formed in good precision. Also, as no convex part is formed by providing a strip line on a dielectric sheet, namely, as the dielectric sheet surface can be made flat, the laminate can be pressed to remove the edge on the side of the strip line formed by pressing the laminate. Further, by forming the second dielectric sheet 2 and the third dielectric sheet 3 in the same thickness and positioning the line section at the center of the first dielectric sheet 1, the strip line 5 can be positioned at the center of the resonator. Accordingly, as it is possible to lead the high frequency current nearly uniformly to the lateral side of the strip line 5, deterioration of the unloaded Q of the dielectric laminated resonator by the conduction loss of the strip line can be further reduced, and as a result it becomes possible to provide a small type, high performance dielectric laminated resonator.

Figure 22:
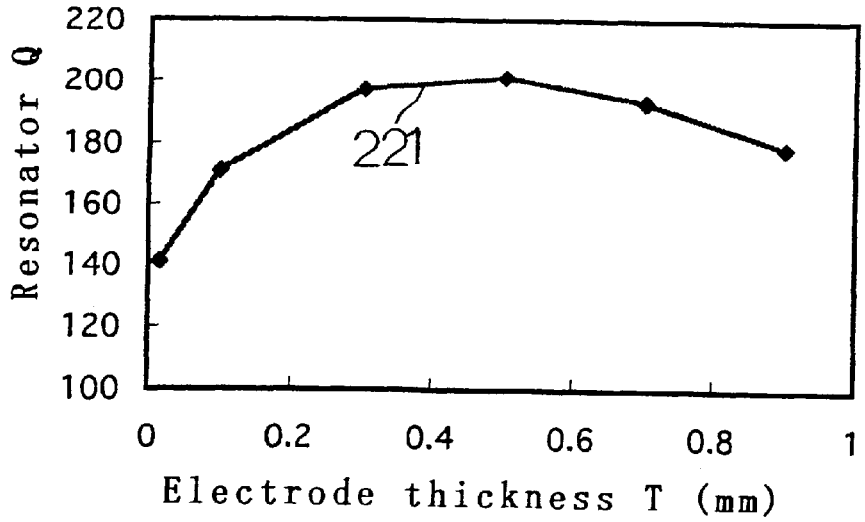
FIG. 22 is a simulation result on the dielectric laminated resonator in the first embodiment of the present invention.

In FIG. 22 there is shown an example of the simulation results of the dielectric laminated resonator in this embodiment. In the laminated dielectric resonator as shown in FIG. 1, for example, in case of using a $Bi_2O_3$—CaO—$Nd_2O_5$ type dielectric material (dielectric constant Er=58, material Q=2000), using a silver paste (conductor resistance R=5.2 $\mu\Omega$/cm) for the electrode, and setting the dielectric laminated resonator to a breadth B=2 mm, height H=2 mm, length L=5 mm, and the line width of the strip line 5 W=0.5 mm, under which the line thickness T is varied, the variation of the unloaded Q is shown in the graph 221.

In FIG. 22, the line thickness in case of forming a strip line by screen printing is about 15 $\mu$m, and the unloaded Q by simulation=141, but edges of the lateral side of the strip line is collapsed and the unloaded Q is deteriorated to 120. To the contrary, according to this embodiment, collapse of the edges on the lateral sides of the strip line can be avoided, so that, by thickening the line thickness T the unloaded Q is improved to a level almost as simulated, i.e., the unloaded Q at the time of the line thickness T=0.5 mm comes to be 201, thereby making it possible to confirm that the improvement of the unloaded Q by more than 50% can be realized.

Further, by connecting the first shield electrode 6 with the second shield electrode 7 through the ground electrode 8 and side electrodes 9, 10, the first shield electrode 6 and the second shield electrode 7 can be kept in an equal potential, and their respective self-resonances do not occur.

Embodiment 2

Hereinafter, the second embodiment of the present invention is explained with reference to the drawings.

Figure 5:
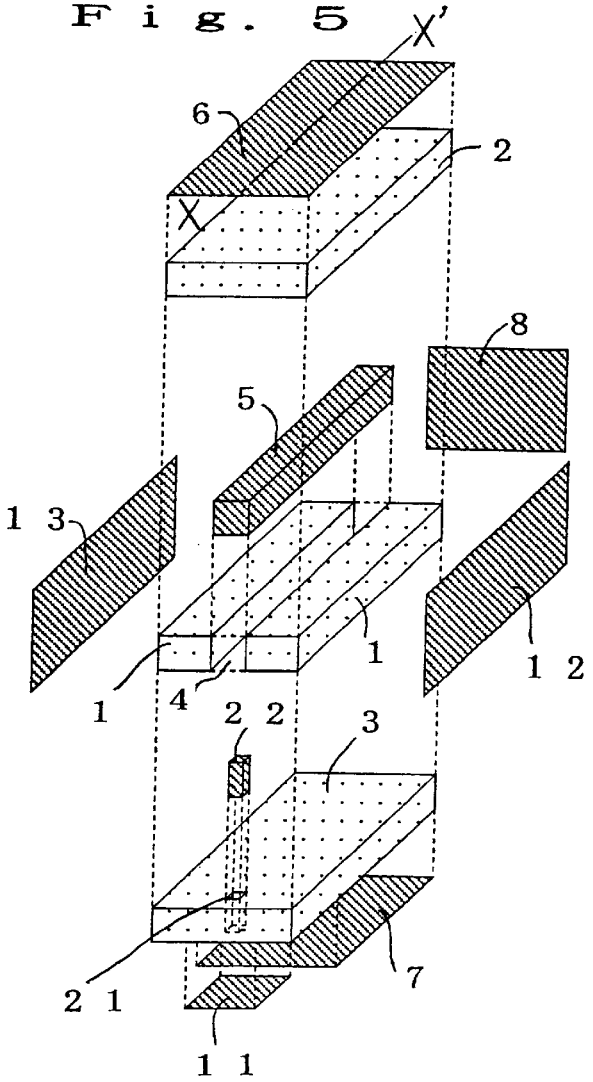
FIG. 5 is a disassembled perspective view of the dielectric laminated resonator in FIG. 4.
Figure 6:
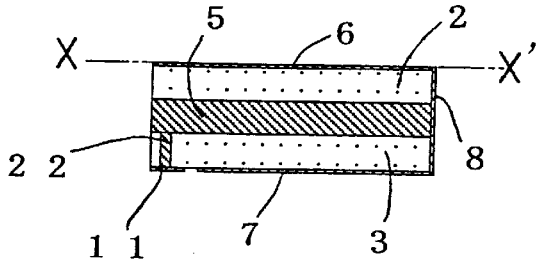
FIG. 6 is a sectional view of a plane including the line X–X' in FIG. 4.
Figure 36A:
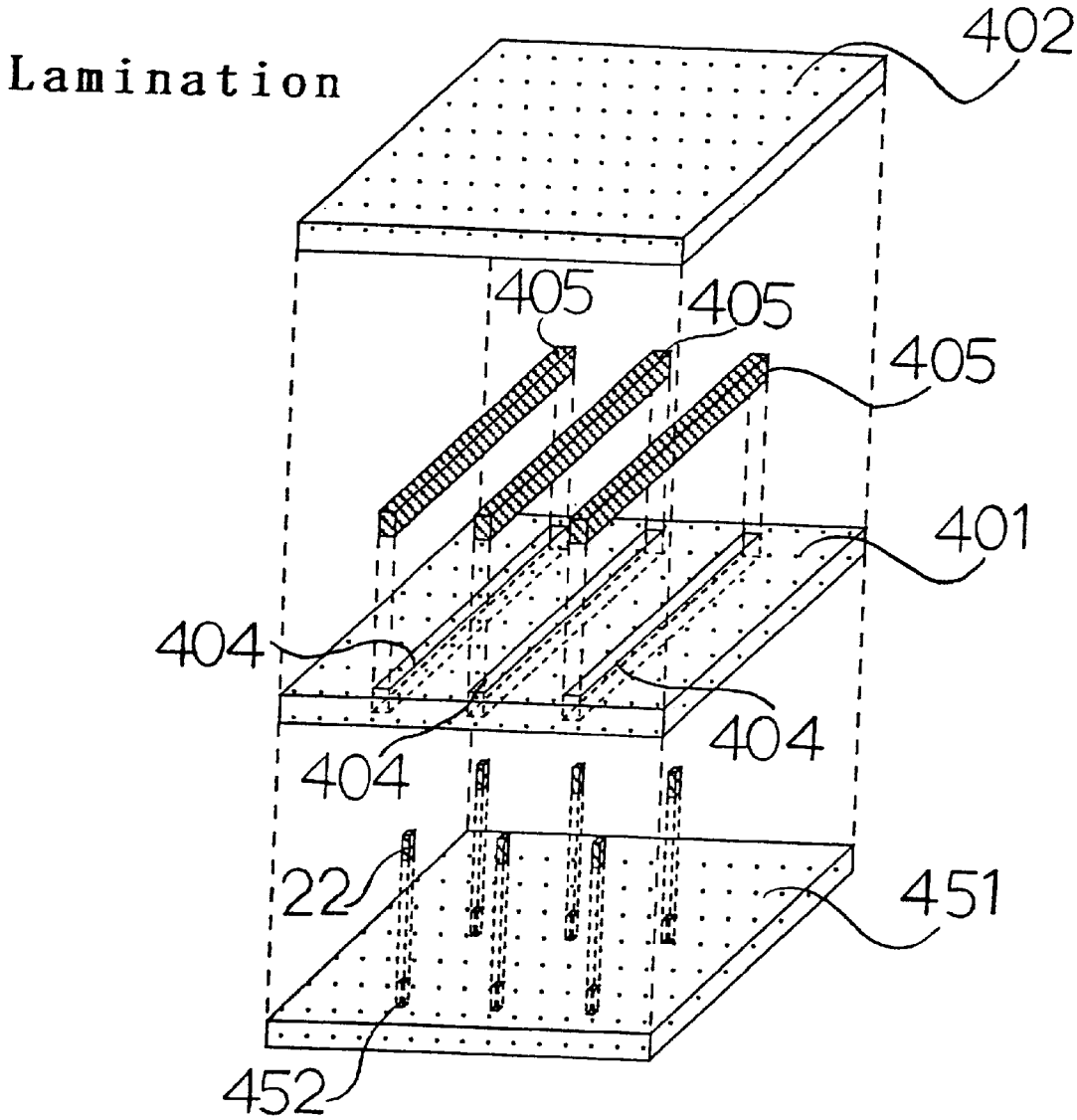
FIG. 36(A)–FIG. 36(C) are schematic views to illustrate the manufacturing steps of the dielectric laminated resonator in the second embodiment of the present invention.
Figure 36B:
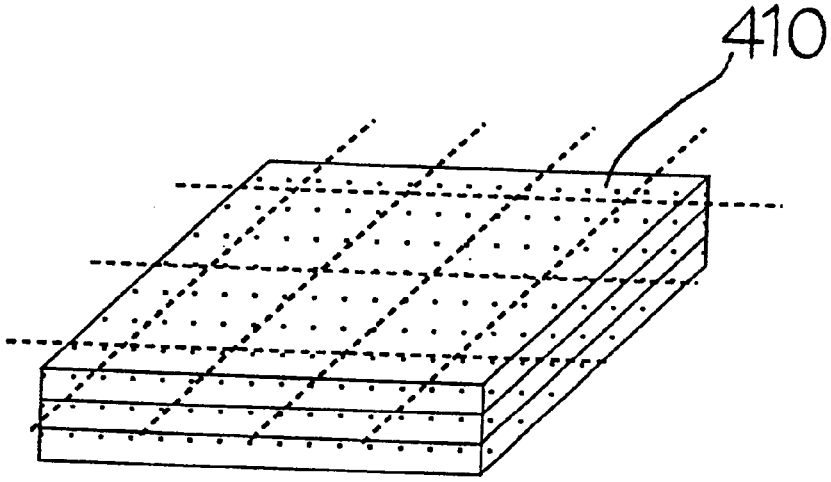
Figure 36C:
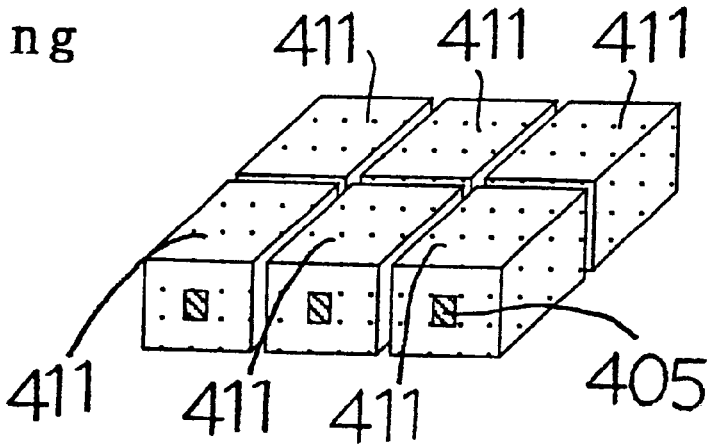

FIG. 4 is a perspective view of a dielectric laminated resonator in an embodiment of the dielectric laminated device of the present invention. FIG. 5 is a disassembled perspective view in FIG. 4. Further, FIG. 6 is a sectional view of a plane including the line X–X' in FIG. 4. FIG. 36(A)–FIG. 36(C) are schematic views to illustrate the manufacturing steps of the dielectric laminated resonator in the present embodiment.

In this paragraph, firstly, while referring to FIG. 36 (A)–FIG. 36(C), a summary of the manufacturing steps of the dielectric laminated resonator of the present embodiment is described, and next, while explaining the details thereof, the constitution of the dielectric laminated resonator is simultaneously explained.

The manufacturing steps of the dielectric laminated resonator of the present embodiment are approximately the same as those described in the first embodiment with the exception of the following points, and are designed to manufacture a plurality of dielectric laminated resonators from the same laminate.

Next, using FIG. 36(A)–FIG. 36(C), the different points are mainly described.

As shown in FIG. 36 (A), in the present embodiment, besides the dielectric sheet 401 corresponding to one dielectric sheet of the present invention, a dielectric sheet 451 corresponding to another dielectric sheet of the present invention is also used.

The dielectric sheet 451 has a plurality of through holes 452 corresponding to the space for imbedding according to the present invention. In these through holes 452 the electrode materials which are conductive materials are imbedded to form a through hole electrode 22.

On the other hand, with respect to the dielectric sheet 401, a strip line 405 is formed in the same procedure as that described in Embodiment 1 by laminating on the dielectric sheet 451.

Other steps are the same as those of the above Embodiment 1.

With respect to the dielectric laminated resonator made by the manufacturing steps as described above, next, while referring to FIG. 4–FIG.6, details of the manufacturing processes are further explained, and simultaneously the constitution of said dielectric laminated resonator is also explained.

In FIG. 4, FIG. 5 and FIG. 6, the part 1 is a first dielectric sheet, 2 is a second dielectric sheet, and 3 is a third dielectric sheet. For these dielectric sheets there is used a low temperature sintered dielectric ceramic of green sheet form having a thickness of more than 40 $\mu$m.

The first dielectric sheet 1 has an opening 4 of rectangular parallelepiped formed by punching with a puncher or a punching mold. The opening 4 is formed in a form to extend from one lateral side of the first dielectric sheet 1 to the other opposite lateral side, and both end faces thereof are formed in a manner to be disposed at the central parts of said one lateral side and the other lateral side.

The width of the section of said opening 4 is formed in the same thickness as that of the sheet thickness of the first dielectric sheet 1, namely, in a square sectional shape.

The third dielectric sheet 3 has a through hole 21 made by punching with a puncher or a punching mold. In the through hole 21, an electrode material such as a silver paste or metal plate is imbedded to form a through hole electrode 22.

The third dielectric sheet 3 is formed in the same thickness as the second dielectric sheet 2.

The first dielectric sheet 1 is laminated with the third dielectric sheet 3 which is disposed underneath, and an electrode material such as a silver paste or a metal plate is imbedded in the opening part 4 to form a strip line 5 of rectangular parallelepiped, which is then laminated with the second dielectric sheet 2 disposed above the first dielectric sheet 1. An end of the through hole electrode 22 is connected with the strip line 5.

A laminate formed by laminating the dielectric sheets 1, 2 and 3 is pressed, and each dielectric sheet 1, 2 and 3 and the strip line 5 which is an internal electrode, and a through hole electrode 22, are simultaneously calcined at a temperature of no more than 960° C. which is a melting point of silver.

Also, on the whole upper surface of the laminate calcined as above, namely, on the whole upper surface of the second dielectric sheet 2, the first shield electrode 6 is formed as an external electrode by means of screen printing or the like using an electrode material such as a silver paste. Further, on the lower surface of the laminate calcined as above, namely, on the lower surface of the third dielectric sheet 3, the second shield electrode 7 and island form input and output electrode 11 are formed as external electrodes by the similar means to that used in the first shield electrode 6.

Further, in the calcined laminate, on the whole surface of a lateral side crossing at an orthogonal direction with the line length direction of the strip line 5, a ground electrode 8 is formed as an external electrode by the same means as that of the first shield electrode 6, and the lateral side shield electrodes 12, 13 are formed on the whole surface of both lateral sides crossing at an orthogonal direction with the width direction of the strip line 5, as external electrodes.

In addition, an end of the strip line 5 is connected to the ground electrode 8, and the other end of the through hole electrode 22 is connected to the input and output electrode 11. The first shield electrode 6 and the second shield electrode 7 are mutually connected through the ground electrode 8 and lateral shield electrodes 12, 13.

As described above, this embodiment shows the same operation and characteristics as those of the first embodiment. Besides, by making the cross-sectional shape of the opening 4 of the rectangular parallelepiped square shape, i.e., by making the cross-sectional shape of the rectangular parallelepiped strip line 5 square, concentration of the high frequency electric current on the lateral side of the strip line 5 is evaded, by which the high frequency current can be led more uniformly, and the conduction loss in strip line can be further reduced. Also, by providing the strip line 5 in a manner to be positioned at the central part of the section of the dielectric laminated resonator, the electromagnetic field distribution in the dielectric laminated resonator can be made more uniform than in the first embodiment.

These contents are apparent from the simulation results given in FIG. 22, wherein, when the line thickness T=0.5 mm in which the sectional shape becomes square, the unloaded Q becomes the largest, showing Q=201.

Further, by providing the side shield electrodes 12, 13, the resonator can be fully sealed to remove the radiation loss of high frequency current almost perfectly. Accordingly, it is possible to realize a miniature, high performance dielectric laminated resonator which shows high unloaded Q.

Moreover, as it is possible to shield fully the resonator, with the lateral side shield electrodes 12, 13, the electromagnetic interference between the dielectric laminated resonator and an external circuit and the coupling between the resonators in case of arranging the dielectric laminated resonators close to one another can be prevented.

In addition, by providing the through hole electrode 22 and input and output electrode 11, connection with the external circuit can be facilitated easily, parts such as input and output fittings can be curtailed, and the substantial mounting area of the dielectric laminated resonator can be reduced, so that the miniature size module such as dielectric filter can be realized.

In this embodiment, description has been made on the case of providing an input and output electrode 11 separately from the through hole electrode 22, but it is possible to have the through hole electrode possess the function of the input and output electrode at the same time. In such a case, there should be a contrivance to make the sectional area of the through hole electrode larger or the like. With respect to said point, more detailed description will be given in Embodiment 9.

Embodiment 3

Hereinafter, the third embodiment of the present invention is explained with reference to the drawings.

Figure 8:
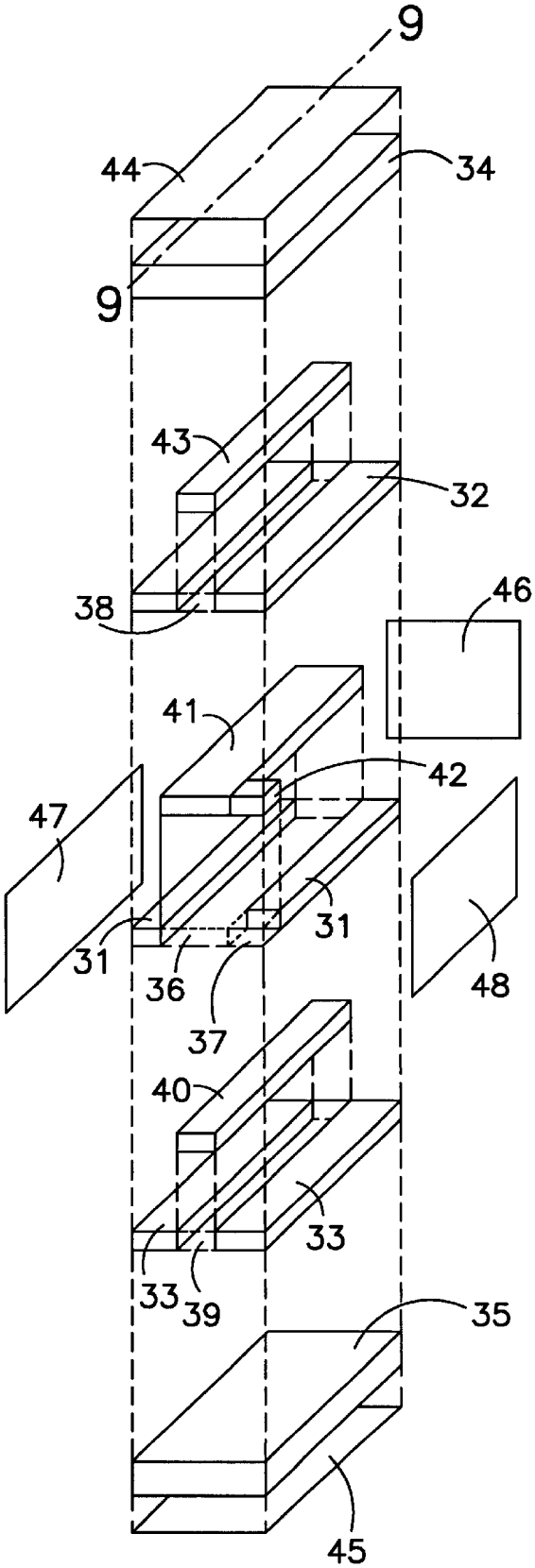
FIG. 8 is a disassembled perspective view of the dielectric laminated resonator in FIG. 7.
Figure 7:
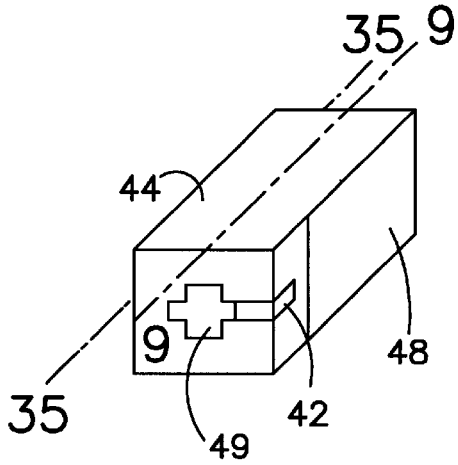
FIG. 7 is a perspective view of a dielectric laminated resonator in the third embodiment of the present invention.
Figure 9:
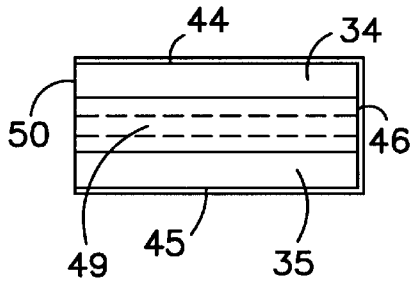
FIG. 9 is a sectional view of a plane including the line X–X' in FIG. 7.
Figure 35:
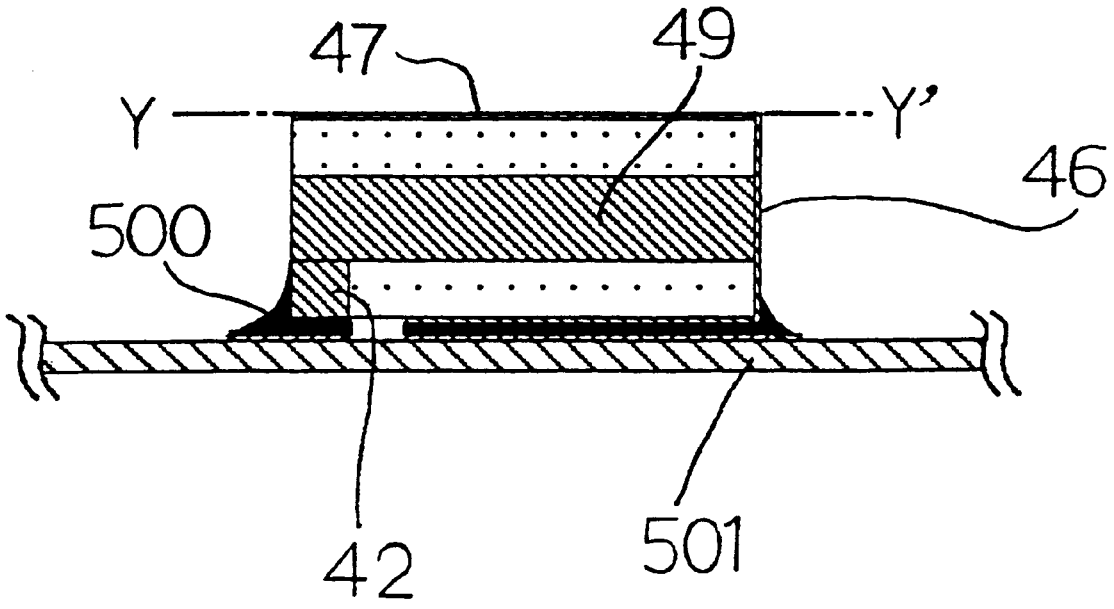
FIG. 35 is a sectional view and a mounting view of a plane including the line Y–Y' in FIG. 7.

FIG. 7 shows a perspective view of a dielectric laminated resonator in a embodiment of the present invention. FIG. 8 shows a disassembled perspective view in FIG. 7. Further, FIG. 9 shows a section of a plane including the line X–X' in FIG. 7. In addition, FIG. 35 shows a section and mounting of a plane including the line Y–Y' in FIG. 7. Also, FIG. 37(A)–FIG. 37(C) show schematic diagrams of the manufacturing steps of the dielectric laminated resonator in this embodiment.

Figure 37A:
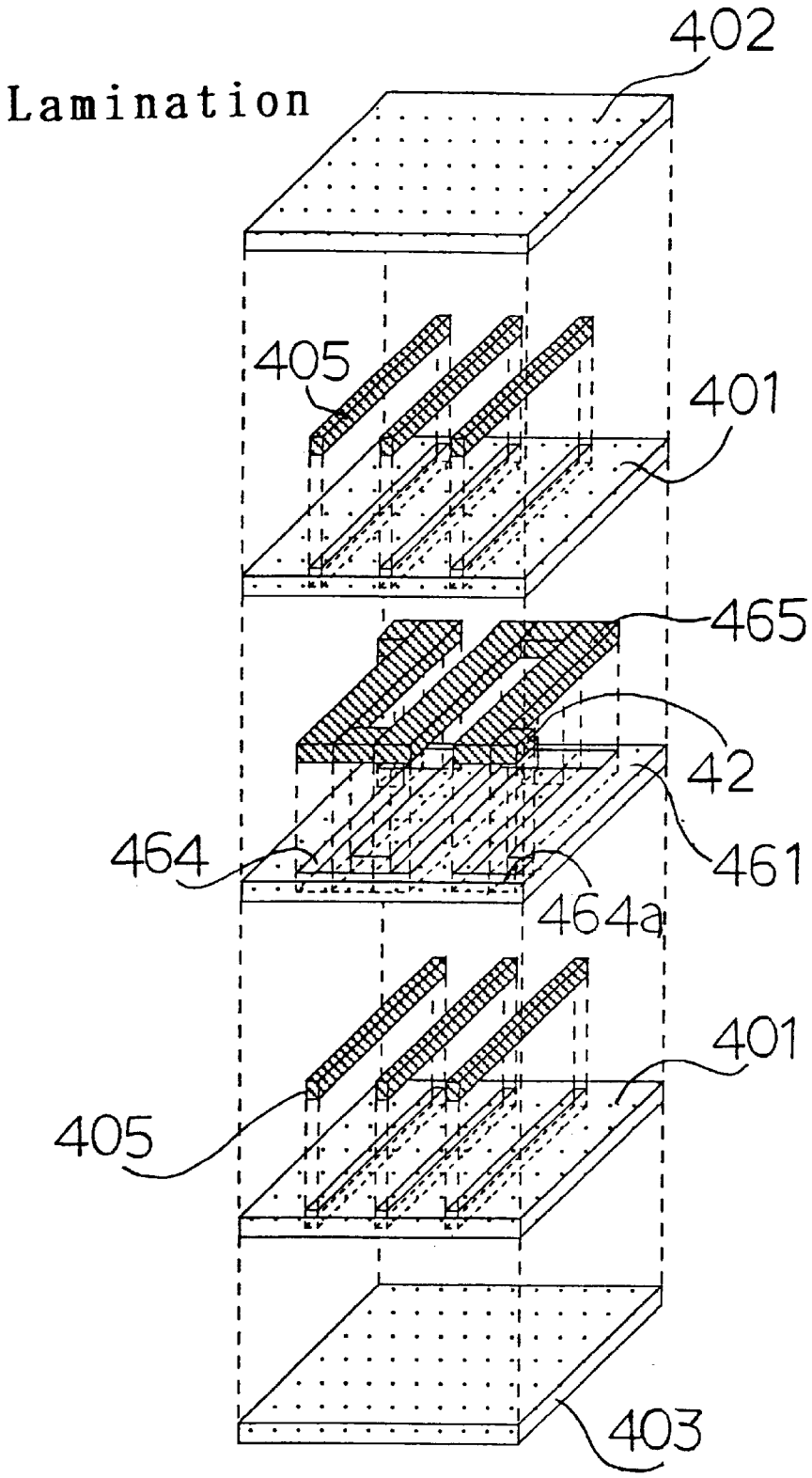
FIG. 37(A)–FIG. 37(C) are schematic views to illustrate the manufacturing steps of the dielectric laminated resonator in the third embodiment of the present invention.
Figure 37B:
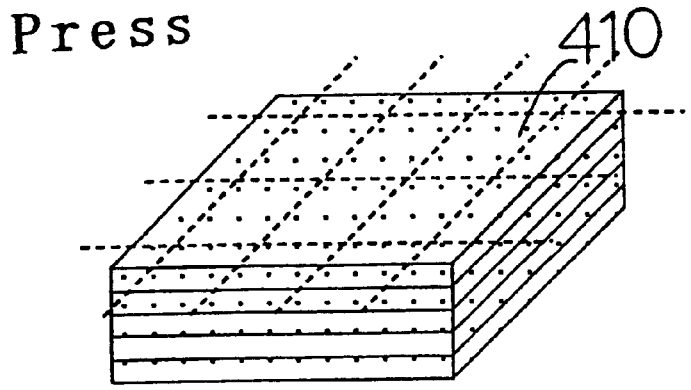
Figure 37C:
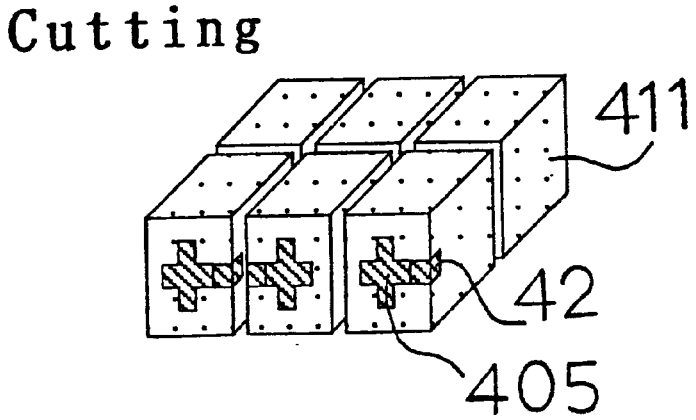

In this passage, first, referring to FIG. 37(A)–FIG. 37(C), outline of the manufacturing steps of the dielectric laminated resonator of this embodiment is described, and then, while explaining the details thereof, constitution of the dielectric laminated resonator is simultaneously explained.

The manufacturing steps of the dielectric laminated resonator of the present embodiment are approximately the same as those described in the first embodiment with the exception of the following points, and are designed to manufacture a plurality of dielectric laminated resonators from the same laminate.

Next, using FIG. 37(A)–FIG. 37(C), the different points are mainly described.

As shown in FIG. 37(A), in the present embodiment, there are used two dielectric sheet 401 and a dielectric sheet 461 to be laminated therebetween. Namely, on the dielectric sheet 461 the notch shaped holes 464*a* are formed on two spots each on a part of the three slit-form openings 464. By the electrode material imbedded in said notch shaped holes 464*a* the input and output line 42 including the input and output electrode is constituted.

With respect to the dielectric laminated resonator made by the manufacturing steps as described above, next, while referring to FIG. 4–FIG.6, details of the manufacturing processes are further explained, and simultaneously the constitution of said dielectric laminated resonator is also explained.

In FIG. 7, FIG. 8 and FIG. 9, the part 31 is a first dielectric sheet, 32 is a second dielectric sheet, 33 is a third dielectric sheet, 34 is a fourth dielectric sheet, and 35 is a fifth dielectric sheet. For each of these dielectric sheets there is used a low temperature sintered dielectric ceramic of green sheet form having a thickness of more than 40 $\mu$m.

The first, second and third dielectric sheets 31, 32 and 33 have openings 36, 38, 39 of rectangular parallelepiped formed by punching with a puncher or a punching mold. Each of the openings is formed in a form to extend from one lateral side of each dielectric sheet to the other opposite lateral side, and the sections thereof are formed to be disposed at the central parts of said one lateral side and the other lateral side.

The first dielectric sheet 31 has an opening 37 of rectangular parallelepiped made by punching with a puncher or a punching mold. Said opening 37 is formed at an orthogonal direction to the opening 36 from the one lateral side of said opening 36, namely, so as to be bent in L-letter form, up to the lateral side of the first dielectric sheet 31.

Furthermore, the second dielectric sheet 32 and the third dielectric sheet 33 are formed in the same thickness. The sectional widths of the openings 38, 39 are formed narrower than the opening 36.

In addition, the fourth dielectric sheet 34 and the fifth dielectric sheet 35 are formed in the same thickness.

The third dielectric sheet 33 is laminated with the fifth dielectric sheet 35 which is disposed underneath, and an electrode material such as a silver paste or a metal plate is imbedded in the opening part 39 to form a third strip line 40 of rectangular parallelepiped. Said third dielectric sheet 33 is then laminated with the first dielectric sheet 31 disposed above. On the first opening 36 and the second opening 37 there are formed the first strip line 41 of rectangular parallelepiped and the input and output line 42 of rectangular parallelepiped, in the same manner as done with the opening 39. The first dielectric sheet 31 is laminated with the second dielectric sheet 32 which is disposed above, and a second strip line 43 of rectangular parallelepiped is formed on the opening 38 in the same manner as done with the opening 39, and the second dielectric sheet 32 is laminated with the fourth dielectric sheet 34 which is disposed above.

Also, an end of the input and output line 42 is connected to the first strip line.

Further, each of the strip lines 40, 41 and 43 is surface connected to form a strip line laminate 49 having a cross shaped section.

A laminate formed by laminating the dielectric sheets 31, 32, 33, 34 and 35 is pressed, and each of dielectric sheets 31, 32, 33, 34 and 35, and each of the strip lines 40, 41, and 43 and input and output line 42 which is an internal electrode, are simultaneously calcined at a temperature of no more than 960° C. which is a melting point of silver.

Also, on the whole upper surface of the laminate calcined as above, namely, on the whole upper surface of the fourth dielectric sheet 34, the first shield electrode 44 is formed as an external electrode by means of screen printing or the like using an electrode material such as a silver paste. Further, on the whole lower surface of the laminate calcined as above, namely, on the whole lower surface of the fifth dielectric sheet 35, the second shield electrode 45 is formed as external electrodes by the similar means to that used in the first shield electrode 44.

Further, in the calcined laminate, a ground electrode 46 is formed on the whole surface of a lateral side crossing at an orthogonal direction with the length direction of the strip line, a lateral side shield electrode 47 is formed on the whole surface of a lateral side crossing at an orthogonal direction with the width direction of the strip line, and a lateral side shield electrode 48 is formed on the other lateral side surface crossing at an orthogonal direction with the width direction of the strip line, so as not to interfere with the other end of the input and output line 42, as an external electrode, respectively, by the same means as that of the first shield electrode 44.

In addition, an end of each of the strip lines 40, 41, and 43 is connected to the ground electrode 46, and the first shield electrode 44 and the second shield electrode 45 are mutually connected through the ground electrode 46 and the lateral side shield electrodes 47,48.

As described above, according to this embodiment shows the same operation and characteristics as the those of the second embodiment. Besides, by making surface connection of the first, second and third strip lines 41, 43, and 40 to constitute the strip line laminate 49 having a cross shaped section, the section can be formed into a shape closer to the circle, and the angles in the section can be increased from 4 to 12. Namely, the high frequency current which has a tendency to concentrate on angles of section can be dispersed, and the conduction loss of the strip line can be reduced further. Furthermore, by providing the strip line laminate 49 so as to be positioned at the center of the section of the dielectric laminated resonator, the electromagnetic field distribution in the dielectric laminated resonator can be made more uniform than in the case of the second embodiment. Accordingly, it is possible to realize a miniature, high performance dielectric laminated resonator having higher unloaded Q.

Further, by providing an input and output line 42, the connection with an external circuit can be facilitated, use of parts such as input and output fittings can be curtailed, and substantial mounting area of the dielectric laminated resonator can be reduced, with the result that the small size module such as a dielectric filter can be realized.

Furthermore, by extending the input and output line 42 from the other end of the first strip line 41 at an orthogonal direction to the lateral side of the first dielectric sheet 31, the input and output electrode for connecting with the external circuit may be substituted by the other end of the input and output line 42. Accordingly, the processing steps of the external electrode for the dielectric laminate resonator can be curtailed.

Additionally, in case of the mounting of the dielectric laminated resonator to the mounting substrate 501 by means of such as reflow soldering, by exposing the lateral surface of the input and output line 42 to the open end face 50 of the dielectric laminated resonator as shown in FIG. 35, a solder fillet 500 is formed to make it easy to confirm soldering with the input and output electrode and strengthen the soldering strength. Also, as the other end of the input and output line 42 which is an extra-thick electrode is used as the input and output electrode, there is less tendency for the so-called electrode erosion to occur which is a phenomenon of melting of the electrode in the solder resulting in loss of electrode. Accordingly, it is possible to realize a dielectric laminated, resonator which shows good mounting reliability. Also, needless to say, the input and output electrode which has been fitted as a separate part is unnecessary.

Embodiment 4

Hereinafter, the fourth embodiment of the present invention is explained with reference to the drawings.

Figure 11:
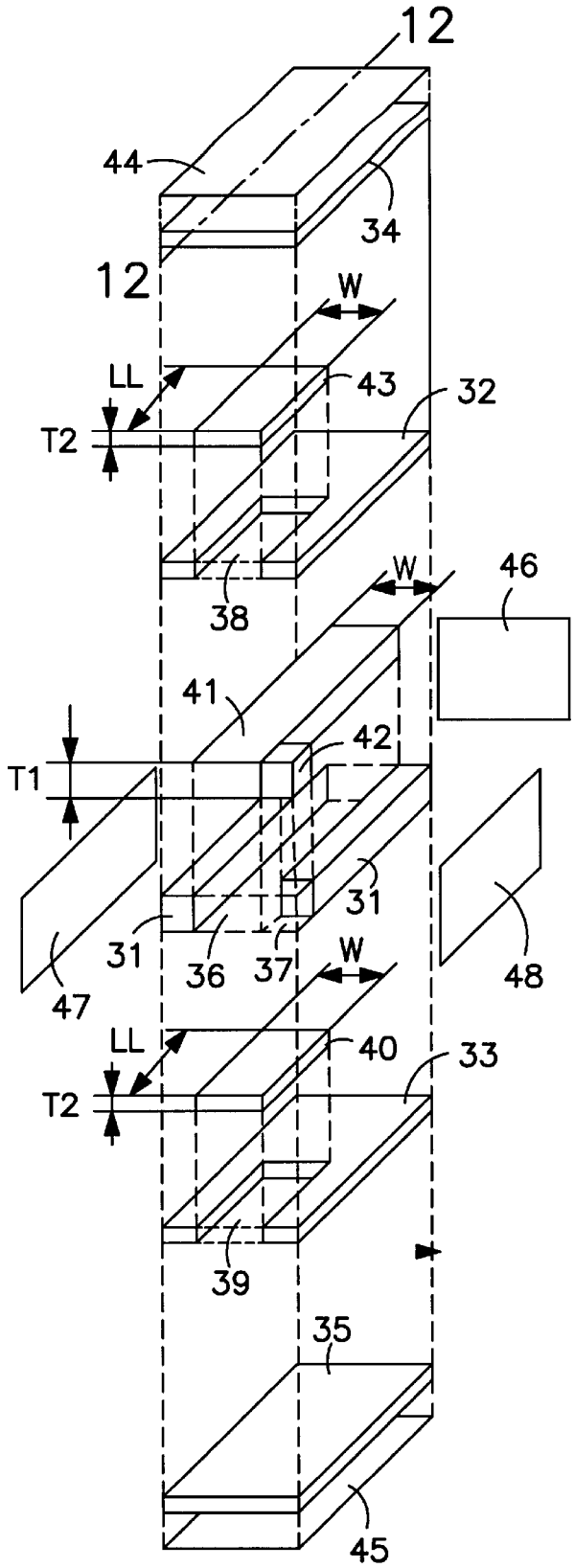
FIG. 11 is a disassembled perspective view of the dielectric laminated resonator in FIG. 10.
Figure 10:
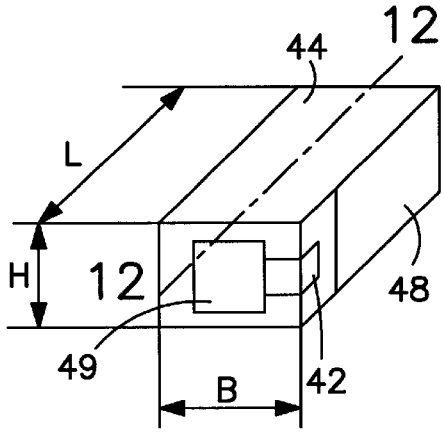
FIG. 10 is a perspective view of a dielectric laminated resonator in the fourth embodiment of the present invention.

FIG. 10 shows a perspective view of a dielectric laminated resonator in the embodiment of the present invention. FIG. 11 shows a disassembled perspective view in FIG. 10. Further, FIG. 12 shows a sectional view of a plane including the line X–X' in FIG. 10.

With respect to the manufacturing process of the dielectric laminated resonator in the embodiment of the present invention, in the same manner as in the third embodiment, a plurality of dielectric laminated resonators are included in the same laminate, the same laminate is cut into separate pieces. After the separate pieces are calcined, the external electrode is printed by baking.

With respect to the dielectric laminated resonator made by the manufacturing steps as described above, details are explained.

Figure 12:
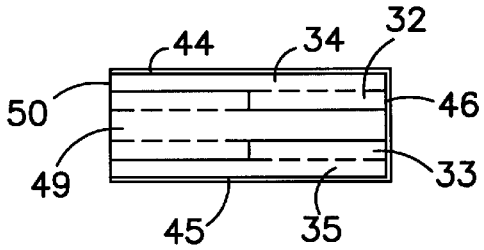
FIG. 12 is a sectional view of a plane including the line X–X' in FIG. 10.

In FIG. 10, FIG. 11 and FIG. 12, the structures are the same as those shown in the third embodiment excepting the following two points. One of the differences is that, while in the third embodiment, in the second dielectric sheet 32 an opening 38 is formed in a style of extending from one side of the second dielectric sheet 32 to the opposite other side, and in the third dielectric sheet 33 an opening 39 is formed in the same manner and shape as in the opening 38, in the present embodiment, in the second dielectric sheet 32, a rectangular parallelepiped opening 38 is formed in a style of extending from a lateral surface of the second dielectric sheet 32 to a half-way part of the dielectric sheet, and on the third dielectric sheet 33 a rectangular parallelepiped opening 39 is formed in the same style and shape as those of the above opening 38.

Other point of difference is that, while in the third embodiment, the widths of the openings 38, 39 are formed narrower than the width of the opening 36 and the strip lines 40, 41, 43 are surface connected respectively to form a strip line laminate 49 having a cross shaped section, in the present embodiment, the widths of the opening parts 38, 39 are formed to be same as the width of the opening 36, and the rectangular parallelepiped strip lines 40, 41, 43 are surface connected respectively to form a strip line laminate 49.

As described above, according to this embodiment, except that a strip line laminate 49 having a cross shaped section in the third embodiment is formed in the third embodiment, the same operation and characteristics are provided, and besides, an end side in which the ground electrode of the strip line laminate 49 is connected is formed into a thin thickness part having thin sectional thickness, and the other end side of the, strip line laminate 49 is formed into a thick thickness part having thick sectional thickness, by which the sectional thickness from the half-way part of the strip line laminate 49 to the other end side can be formed thick, so that the impedance of the dielectric laminated resonator is changed stepwise halfway, or in other words an SIR type resonator is constituted, because of which the resonance frequency is lowered and the length of the resonator can be shortened.

Moreover, as it is possible to constitute an SIR type resonator without narrowing the line width of each of the strip lines 40, 41, 43, the length of the resonator can be shortened with preservation of high unloaded Q. Accordingly, further miniature, high performance dielectric laminated resonator can be realized.

Figure 23:
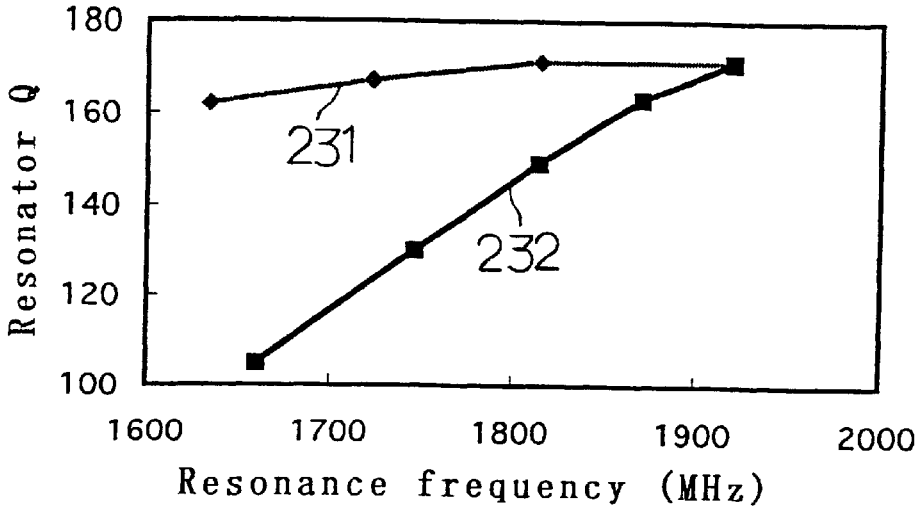
FIG. 23 is a simulation result on the dielectric laminated resonator in the fourth embodiment of the present invention.
Figure 24:
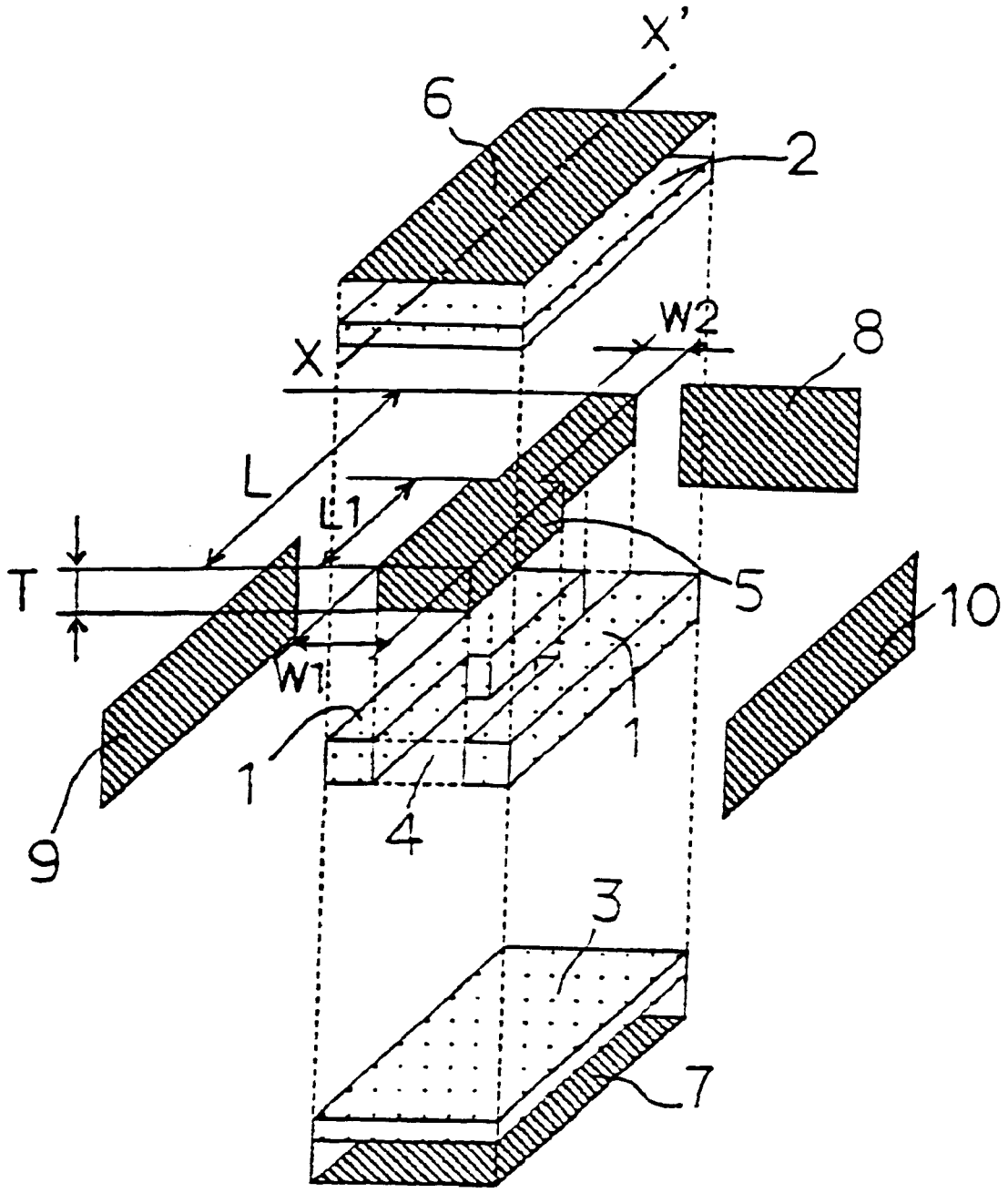
FIG. 24 is a disassembled perspective view of an SIR type dielectric laminated resonator in the first embodiment of the present invention.

FIG. 23 shows an example of simulation results with the dielectric laminated resonator in this embodiment. In the laminated dielectric resonator shown in FIG. 10, for example, using for example $Bi_2O_3$—CaO—$Nd_2O_5$ type dielectric material (dielectric constant r=58, material Q=2000), using a silver paste (conductor resistance R=5.2 $\mu\Omega$/cm) for electrode, setting the dielectric laminate resonator breadth B=2 mm, dielectric laminated resonator height H=2 mm, dielectric laminated resonator length L=5 mm, line width of each of strip line 40, 41, 43 W=0.5 mm, line length of second and third strip lines 40,43 LL=2.5 mm, line thickness of the first strip line 41 T1=0.1 mm, and varying the line thickness T2 of the second and third strip lines 40, 43, the relations between the resonant frequency and the unloaded Q are shown in the graph 231. Further, in the laminated dielectric resonator shown in FIG. 1, an end to which the ground electrode 8 of the strip line 5 is connected is formed in a narrow width part of narrow sectional width, and the other end side of the strip line 5 is formed into a broad width part of wide sectional width, so that, by setting the sectional width broad from the half-way of the strip line 5 to the other end side, an SIR type dielectric laminated resonator as shown in FIG. 24 is formed. In the SIR type dielectric laminated resonator as shown in FIG. 24, using $Bi_2O_3$—CaO—$Nd_2O_5$ type dielectric material (dielectric constant r=58, material Q=2000), using a silver paste (conductor resistance R=5.2 $\mu\Omega$/cm) for electrode, setting the dielectric laminate resonator breadth B=2 mm, height H=2 mm, length L=5 mm, line width of strip line 5 W=0.5 mm, line length of broad width part of strip line 5 L1=2.5 mm, line thickness of the strip line 5 T1=0.1 mm, and varying the line width W2 of the narrow width part of strip line 5, the relations between the resonant frequency and the unloaded Q are shown in the graph 232 in FIG. 23.

In FIG. 23, according to the SIR type dielectric laminated resonator shown in FIG. 24, when the line width of the narrow width part is set to W2=0.1 mm as shown in the graph 232 to enlarge the impedance ratio and lower the resonance frequency to 1660 MHz, the unloaded Q=105 and about 40% unloaded Q is, deteriorated.

To the contrary, in the SIR type dielectric laminated resonator of the present embodiment as shown in FIG. 10, even when the line thickness of the second and third strip lines 40, 43 is set to T2=0.3 mm to increase the impedance ratio and the resonance frequency is lowered to 16234 MHz, the unloaded Q=162 and deterioration of the unloaded Q can be kept to about 5%. Namely, with the high unloaded Q maintained, the resonance frequency can be lowered in the same configuration. Accordingly, it can be confirmed that the compact size, high performance device can be realized.

Embodiment 5

Hereinafter, the fifth embodiment of the present invention is explained with reference to the drawings.

Figure 14:
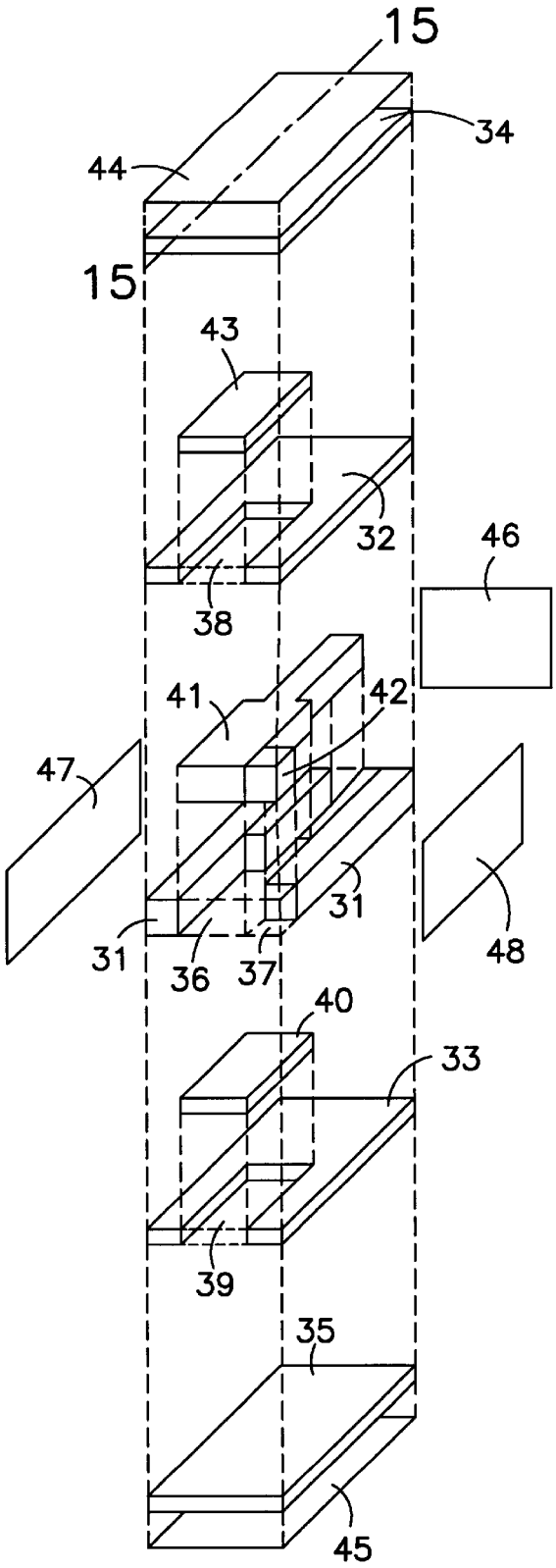
FIG. 14 is a disassembled perspective view of the dielectric laminated resonator in FIG. 13.
Figure 13:
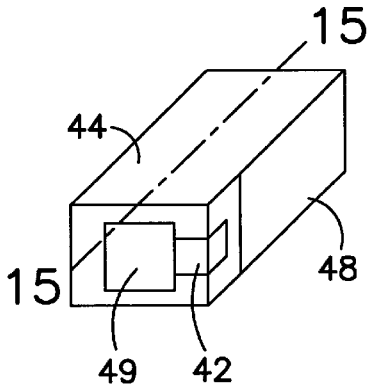
FIG. 13 is a perspective view of a dielectric laminated resonator in the fifth embodiment of the present invention.

FIG. 13 shows a perspective view of a dielectric laminated resonator in the embodiment of the present invention. FIG. 14 shows a disassembled perspective view in FIG. 13. Further, FIG. 15 shows a sectional view of a plane including the line X–X' in FIG. 13.

With respect to the manufacturing process of the dielectric laminated resonator in the embodiment of the present invention, in the same manner as in the third embodiment, a plurality of dielectric laminated resonators are included in the same laminate, the same laminate is cut into separate pieces. After the separate pieces are calcined, the external electrode is printed by baking.

With respect to the dielectric laminated resonator made by the manufacturing steps as described above, details are explained.

Figure 15:
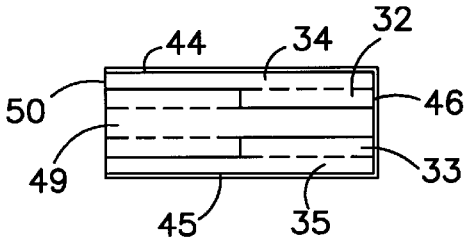
FIG. 15 is a sectional view of a plane including the line X–X' in FIG. 13.

In FIG. 13, FIG. 14 and FIG. 15, the structures are the same as those shown in the fourth embodiment excepting the following point. The difference is that, while in the fourth embodiment, the first opening 36, namely, the first strip line 41, is formed in the same sectional width from one lateral side of the first dielectric sheet 31 to the opposite other lateral side, in the present embodiment, the end side to which the ground electrode 46 of the first strip line 41 is connected is formed in a narrow width part having narrow sectional width, and the other side of the first strip line 41 is formed in a broad width part having broad sectional width, sc that by setting the sectional width of the part from half-way of said first strip line 41 to the other end side broad, an SIR type resonator is formed, wherein an end of the second and third strip lines 43, 40 is connected to the other end of the first strip line 41 and the other end of the second and third strip lines 43, 40 is connected to said half-way part.

As described above, this embodiment shows the same operation and characteristics as those of the fourth embodiment. Besides, the first strip line 41 is formed into an SIR type resonator, because of which the dielectric laminated resonator shows enlarged impedance step ratio, and the length of the dielectric laminated resonator can be further shortened. Furthermore, by adjusting the thickness of the dielectric sheets 31, 32, 33 and the line width of the strip lines 40, 41, 43, it becomes possible to make the sectional shape of the strip line laminate 49 square to provide the same features as those of the second embodiment. Accordingly, further miniature, high performance dielectric laminated resonator can be realized.

Embodiment 6

Hereinafter, the sixth embodiment of the present invention is explained with reference to the drawings.

Figure 17:
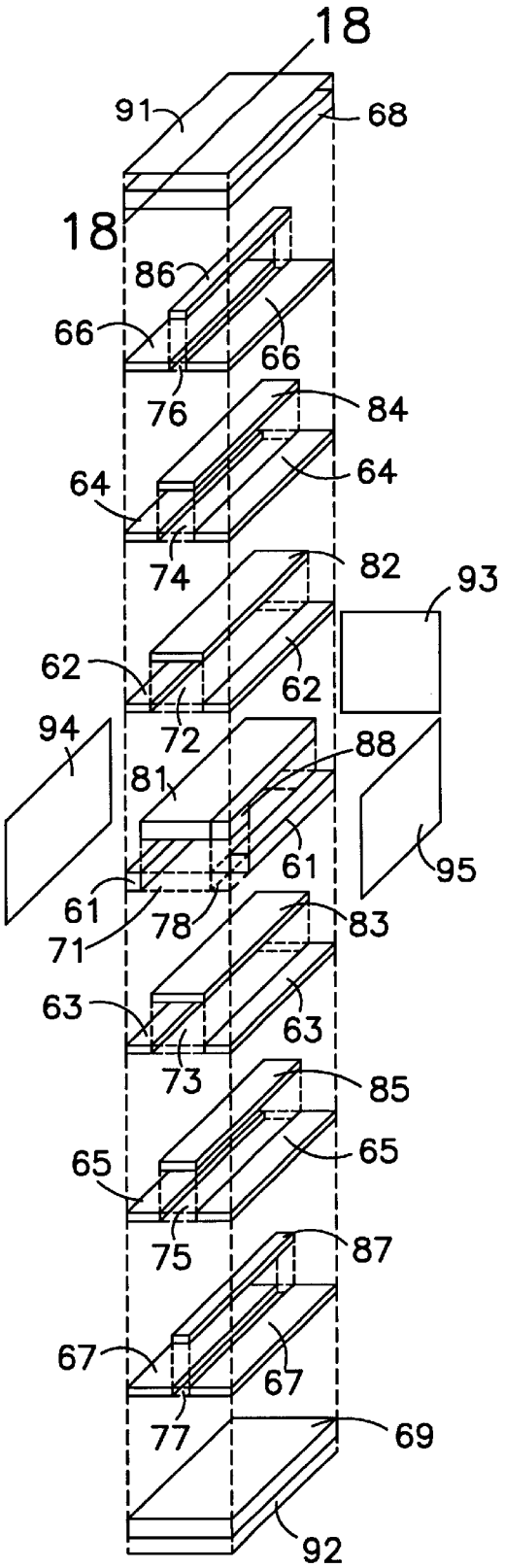
FIG. 17 is a disassembled perspective view of the dielectric laminated resonator in FIG. 16.
Figure 16:
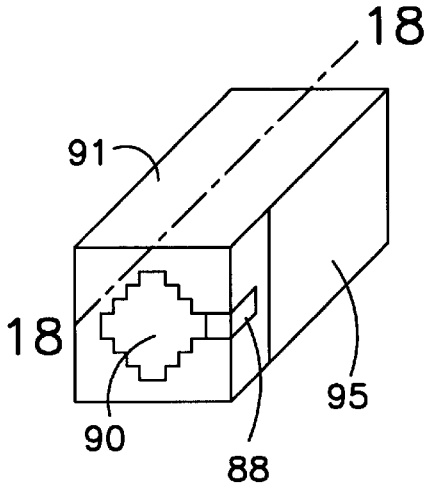
FIG. 16 is a perspective view of a dielectric laminated resonator in the sixth embodiment of the present invention.

FIG. 16 shows a perspective view of a dielectric laminated resonator in the embodiment of the present invention. FIG. 17 shows a disassembled perspective view in FIG. 16. Further, FIG. 18 shows a sectional view of a plane including the line X–X' in FIG. 16.

With respect to the manufacturing process of the dielectric laminated resonator in the embodiment of the present invention, in the same manner as in the third embodiment, a plurality of dielectric laminated resonators are included in the same laminate, the same laminate is cut into separate pieces. After the separate pieces are calcined, the external electrode is printed by baking.

With respect to the dielectric laminated resonator made by the manufacturing steps as described above, details are explained.

Figure 18:
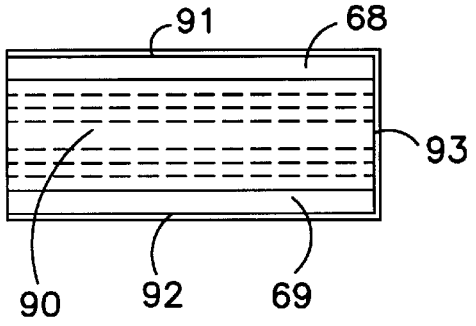
FIG. 18 is a sectional view of a plane including the line X–X' in FIG. 16.
Figure 19:
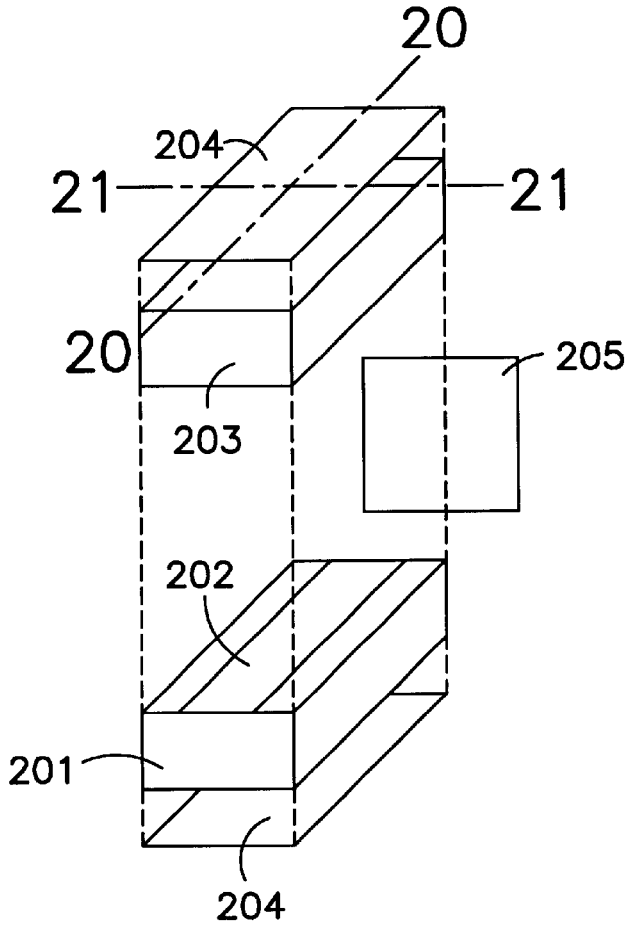
FIG. 19 PRIOR ART
FIG. 19 is a disassembled perspective view of a conventional dielectric laminated resonator.
Figure 20:
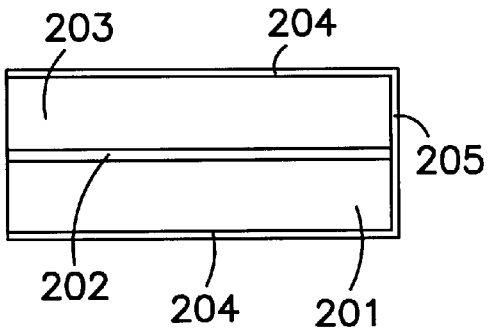
FIG. 20 PRIOR ART
FIG. 20 is a sectional view of a plane including the line X–X' in FIG. 19.
Figure 21:
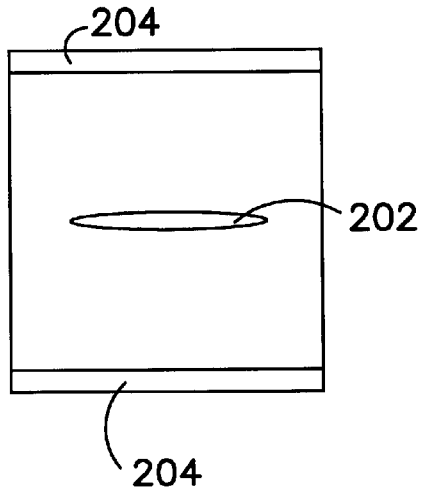
FIG. 21 PRIOR ART
FIG. 21 is a sectional view of a plane including the line Y–Y' in FIG. 19.

In FIG. 16, FIG. 17 and FIG. 18, the part 61 is a first, dielectric sheet, 62 is a second dielectric sheet, 63 is a third dielectric sheet, 64 is a fourth dielectric sheet, 65 is a fifth dielectric sheet, 66 is a sixth dielectric sheet, 67 is a seventh dielectric sheet, 68 is an eighth dielectric sheet, and 69 is a ninth dielectric sheet. For these dielectric sheets, there is used a green sheet form low temperature sintered dielectric ceramic member having a thickness of more than 40 $\mu$m.

The dielectric sheets 61, 62, 63, 64, 65, 66 and 67 have respectively rectangular parallelepiped openings 71, 72, 73, 74, 75, 76, and 77 which are punched out with a puncher or punching mold structures. Each opening is formed in a form to extend from one lateral side of each dielectric sheet to the other opposite lateral side, and the sections thereof are formed to be disposed at the central part between said one side and the other side.

The first dielectric sheet 61 has a rectangular parallelepiped opening 78 which is punched out with a puncher or punching mold structure. Said opening 78 is formed at an orthogonal direction to the opening 71 from the other lateral side of the opening 71, i.e., in a manner to be bent in L-letter shape, to the lateral side of the first dielectric sheet 61.

Further, the respective thicknesses t1, t2, t3, t4, t5, t6, t7 of the dielectric sheets 61, 62, 63, 64, 65, 66, 67 and sectional widths w1, w2, w3, w4, w5, w6, w7 of the openings 71, 72, 73, 74, 76, 77 are formed by the relations represented by the following equations:

$$t\times\tfrac{1}{2}=t2=t3=t4=t5=t6=t7$$

$$w2=w3=t1\times\tfrac{3}{4}$$

$$w4=w5=t1\times\tfrac{1}{2}$$

$$w6=w7=t1\times\tfrac{1}{4}$$

The seventh dielectric sheet 67 is laminated with the ninth dielectric sheet 69 which is disposed underneath, with the electric material such as a silver paste or a metal plate imbedded in the opening 77 to form a rectangular parallelepiped seventh strip line 87, said seventh dielectric sheet 67 is laminated with the fifth dielectric sheet 65 disposed above to form a rectangular parallelepiped fifth strip line 85 on the opening 75 in the same manner as in the opening 77, said fifth dielectric sheet 65 is laminated with the third dielectric sheet 63 disposed above to form a rectangular parallelepiped third strip line 83 on the opening 73 in the same manner as in the opening 77, said third dielectric sheet 63 is laminated with the first dielectric sheet 61 disposed above to form a rectangular parallelepiped first strip line 81, a rectangular parallelepiped input and output line 88 on the opening 71, 78 respectively in the same manner as in the opening 77, said first dielectric sheet 61 is laminated with the second dielectric sheet 62 disposed above to form a rectangular parallelepiped second strip line 82 on the opening 72 in the same manner as in the opening 77, said second dielectric sheet 62 is laminated with the fourth dielectric sheet 64 disposed above to form a rectangular parallelepiped fourth strip line 84 on the opening 74 in the same manner as in the opening 77, said fourth dielectric sheet 64 is laminated with the sixth dielectric sheet 66 disposed above to form a rectangular parallelepiped sixth strip line 86 on the opening 76 in the same manner as in the opening 77, and said sixth dielectric sheet 66 is laminated with the eighth dielectric sheet 68 disposed above.

Also, an end of the input and output line 88 is connected to the first strip line 81.

Further, the strip lines 81, 82, 83, 84, 85, 86, 87 are respectively surface connected to form a strip line laminate 90 having approximately circular sectional shape.

The laminate formed by laminating the dielectric sheets is pressed, and the dielectric sheets and the strip line and input and output line which are internal electrodes are simultaneously calcined at no more than 960° C. which is the melting point of silver.

Further, on the whole upper surface of the calcined laminate, i.e., on the whole surface of the upper surface of the eighth dielectric sheet 68, the first shield electrode 91 is formed as an external electrode by means of the screen printing of the electrode material such as a silver paste, and on the whole lower surface of the calcined laminate, i.e., on the whole lower surface of the ninth dielectric sheet 69, the second shield electrode 92 is formed as an external electrode by the same means as with the first shield electrode 91.

Furthermore, in said calcined laminate, there are formed a ground electrode 93 on the whole surface of one lateral side which crosses at an orthogonal direction with the line length direction of the strip line, a lateral side shield electrode 94 on the whole surface of one lateral side which crosses at an orthogonal direction with the width direction of the strip line, a lateral side shield electrode 95 on the other lateral side which crosses at an orthogonal direction with the width direction of the strip line so as not to interfere with the other end of the input and output line 88, respectively as an external electrode by the same means as with the first shield electrode 91.

In addition, an end of each strip line is connected with the ground electrode 93, and the first shield electrode 91 and the second shield electrode 92 are mutually connected through the ground electrode 93 and lateral side shield electrodes 94, 95.

As described above, this embodiment shows the same operation and characteristics as those of the third embodiment. Besides, by forming a strip line laminate 90 having approximately circular cross-section by surface connecting the strip lines, the high frequency current which has a tendency to concentrate on the corners of the section can be further dispersed, and the conduction loss of the strip line can be further reduced. Further, by providing a strip line laminate 49 so as to be positioned at the center of the section of the dielectric laminated resonator, the electromagnetic field distribution in the dielectric laminated resonator can be more uniform than with the third embodiment. Accordingly, it is possible to obtain nearly same characteristics as those of the dielectric coaxial resonator, and to realize a further miniature, high performance dielectric laminated resonator having high unloaded Q.

Embodiment 7

Hereinafter, the seventh embodiment of the present invention is explained with reference to the drawings.

Figure 25:
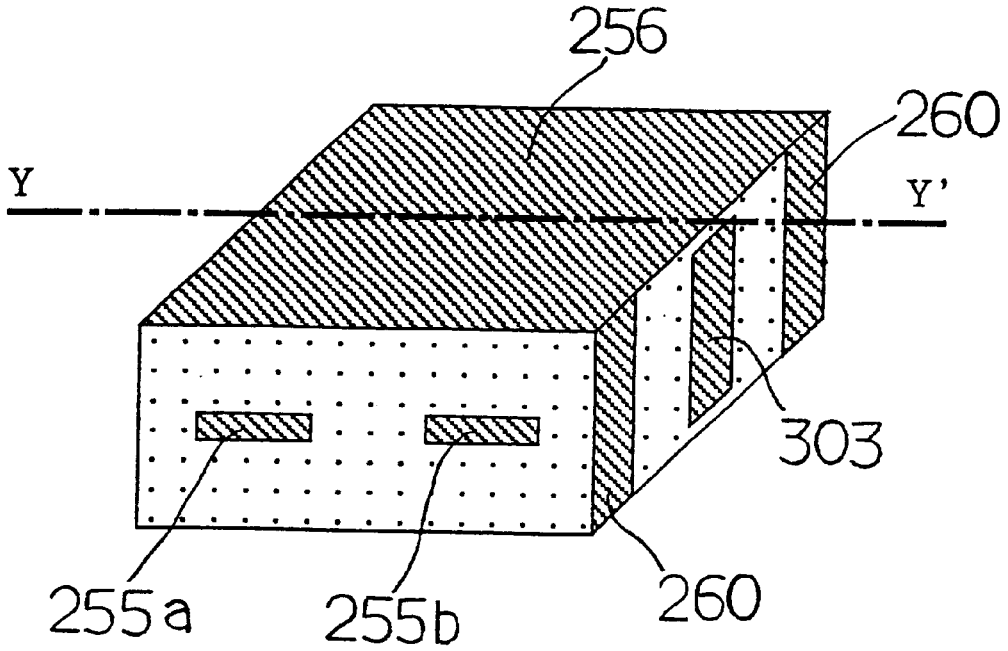
FIG. 25 is a perspective view of a dielectric laminated filter in the seventh embodiment of the present invention.
Figure 26:
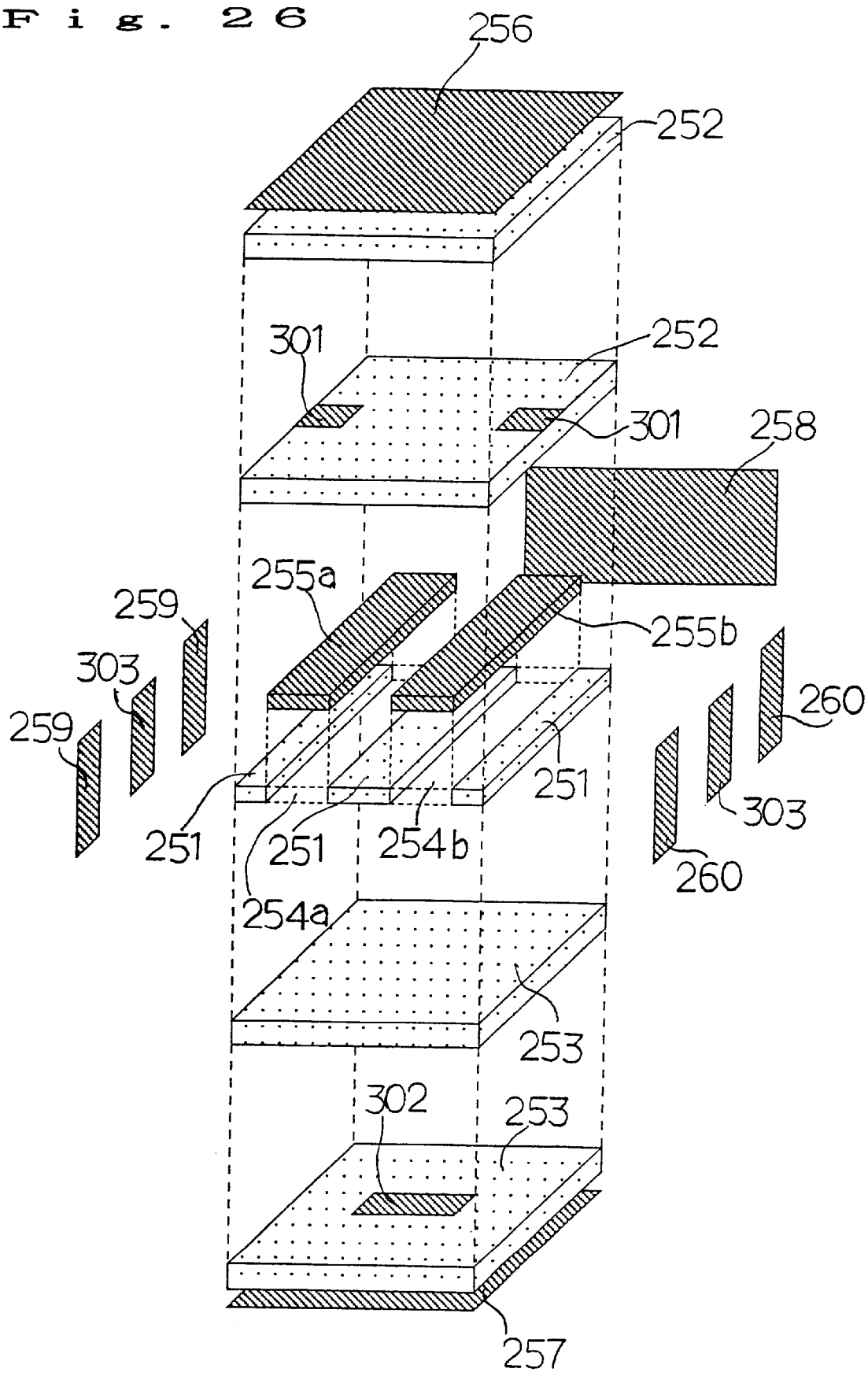
FIG. 26 is a disassembled perspective view of the dielectric laminated filter in FIG. 25.

FIG. 25 shows a perspective view of a dielectric laminated filter in the embodiment of the present invention. FIG. 26 shows a disassembled perspective view in FIG. 25. Further, FIG. 27 shows a sectional view of a plane including the line Y–Y' in FIG. 25.

With respect to the manufacturing process of the dielectric laminated filter in the embodiment of the present invention, in approximately the same manner as in the first embodiment, a plurality of dielectric laminated filters are included in the same laminate, the same laminate is cut into separate individual pieces. After the separate individual pieces are calcined, the external electrode is printed by baking.

With respect to the dielectric laminated filter made by the manufacturing steps as described above, details are explained.

Figure 27:
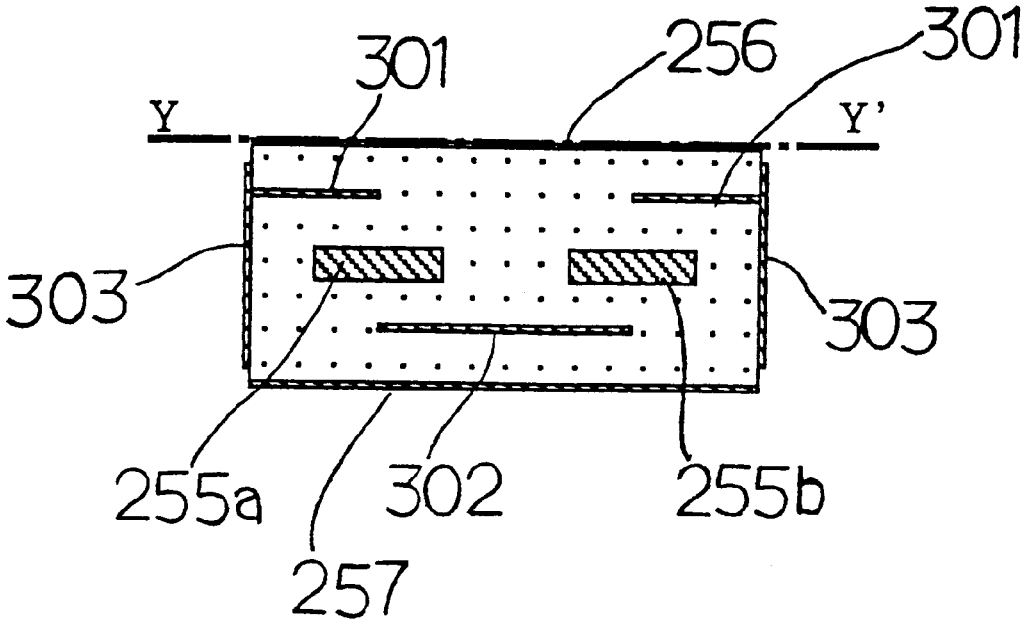
FIG. 27 is a sectional view of a plane including the line Y–Y' in FIG. 25.

In FIG. 25, FIG. 26 and FIG. 27, a part 251 is a first dielectric sheet, 252 is a second dielectric sheet, and 253 is a third dielectric sheet. For these dielectric sheets there are used the low temperature sintered dielectric ceramics formed into green sheet having a thickness of more than 40 $\mu$m.

The first dielectric sheet 251 has rectangular parallelepiped openings 254*a*, 254*b* punched with a puncher or a punching mold, and said openings 254*a*, 254*b* are formed in a form of extending from one lateral side of the first dielectric sheet 251 to the opposite other lateral side thereof.

The third dielectric sheet 253 is formed in the same thickness as that of the second dielectric sheet 252. The input and output coupling electrode 301 is contained in the second dielectric sheet 252, and the coupling electrode 302 is contained in the third dielectric sheet 253.

The first dielectric sheet 251 is laminated with the third dielectric sheet 253 disposed underneath, and, with the electrode material such as a silver paste or a metal plate imbedded in the openings 254*a*, 254*a*, rectangular parallelepiped strip lines 255*a*, 255*b* are formed, which are laminated with the second dielectric sheet 252 disposed above the first dielectric sheet 251.

The laminate formed by laminating the dielectric sheets 251, 252, and 253 is pressed, and the dielectric sheets 251, 252, and 253 and the strip lines 255*a*, 255*b* which are internal electrodes, input and output coupling electrode 301, and coupling electrode 302 are simultaneously calcined at no more than 960° C. which is the melting point of silver.

Further, on the whole upper surface of the calcined laminate, the first shield electrode 256 is formed as an external electrode by means of the screen printing of the electrode material such as a silver paste, and on the whole lower surface of the calcined laminate, the second shield electrode 257 is formed as an external electrode by the same means as those of the first shield electrode 256.

Furthermore, in said calcined laminate, there is formed a ground electrode 258 on one lateral side which crosses at an orthogonal direction with the line length direction of the strip lines 255*a*, 255*b*, by the same means as in the first shield electrode 256. Also, on both lateral sides of the strip lines 255*a*, 255*b* in the width direction, there are formed the lateral side electrodes 259, 260, and input and output electrode 303, as external electrodes, by the same means as those of the first shield electrode 256.

In addition, an end of the strip lines 255*a*, 255*b* is connected with the ground electrode 258, and the other end is left open. The first shield electrode 256 and the second shield electrode 257 are connected each other through the ground electrode 258 and lateral side electrodes 259, 260. Also, an end of the input and output coupling electrode 301 is connected to the input and output electrode 303.

With respect to the dielectric laminated filter constituted as above, the operation is explained.

By grounding an end of the strip lines 255*a*, 255*b* through the ground electrode 258, a tip short-circuited strip line resonator is constituted. The impedance at the other end (open end) of the strip line becomes infinite at the frequency at which the length of the strip line becomes ¼ wavelength and the resonator shows parallel resonance. Also, the strip lines 255*a*, 255*b* are mutually put to electromagnetic coupling to form a coupling capacity with the coupling electrode 302 and an input and output capacity with the input and output coupling electrode 301, thereby forming a band pass filter having the input and output electrode 303 as an input and output terminal.

As described above, according to this embodiment, by imbedding the electrodes in the open parts 254*a* and 254*b* of the dielectric sheet to form rectangular parallelepiped strip lines 255*a*, 255*b*, the line thickness of the strip line can be thickened to about 1 mm, and the line thickness can be made thicker than the case of forming by the screen printing or the like. Consequently, the electromagnetic coupling between the strip lines 255*a* and 255*b* can be strengthened, and wide band filter can be realized.

Furthermore, by forming a strip line on the dielectric sheet, no convex part is formed, i.e., the dielectric sheet face can be made flat, so that the collapse of the edges on the lateral sides of the strip line formed by pressing the laminate can be evaded. Accordingly, the distance between the strip lines 255*a* and 255*b* can be realized in good precision, with the result that the stabilized filter characteristics can be realized.

Furthermore, as it is possible to lead the high frequency current almost uniformly on the lateral sides of the strip lines 255*a* and 255*b*, deterioration of unloaded Q of the dielectric laminate resonator by the conduction loss of the strip line can be reduced, and as a result, miniature sized high performance dielectric laminated filter can be realized.

In addition, because the first shield electrode 256 and the second shield electrode 257 are connected each other through the ground electrode 258 and lateral side electrodes 259, 260, the first shield electrode 256 and the second shield electrode 257 can be kept in equal potentials, and their self resonance can be eliminated. Accordingly, more stabilized filter characteristics can be realized.

Embodiment 8

Hereinafter, the eighth embodiment of the present invention is explained with reference to the drawings.

Figure 28:
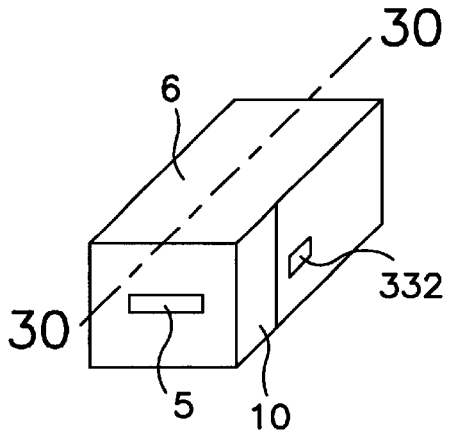
FIG. 28 is a perspective view of a dielectric laminated resonator in the eighth embodiment of the present invention.

FIG. 28 shows a perspective view of a dielectric laminated resonator in the embodiment of the present invention.

Figure 29:
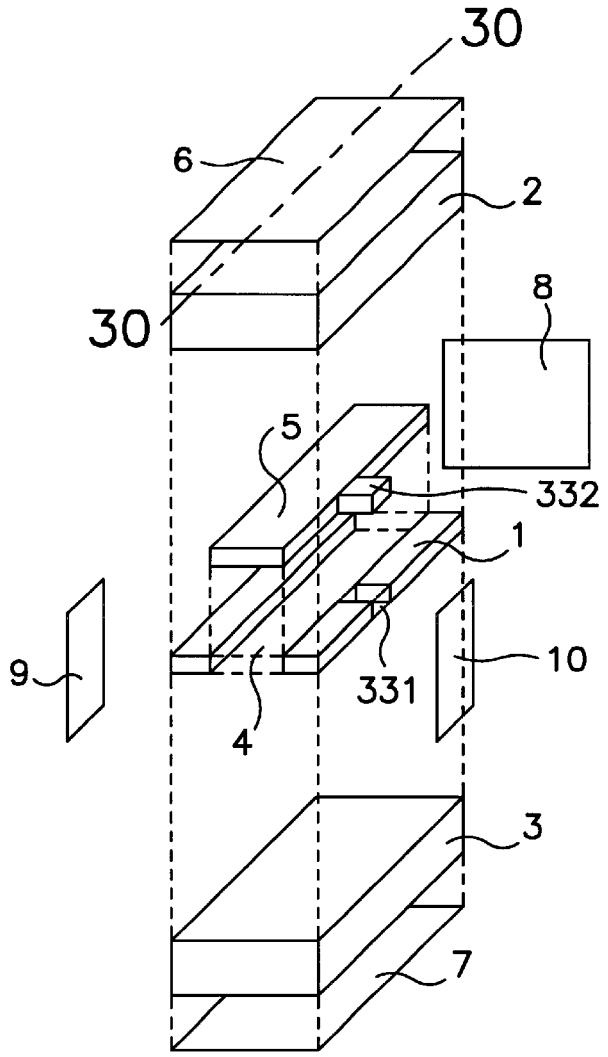
FIG. 29 is a disassembled perspective view of the dielectric laminated resonator in FIG. 28.

FIG. 29 shows a disassembled perspective view in FIG. 28. Further, FIG. 30 shows a sectional view of a plane including the line X–X' in FIG. 28.

With respect to the manufacturing process of the dielectric laminated resonator in the embodiment of the present invention, in the same manner as in the first embodiment, a plurality of dielectric laminated resonators are included in the same laminate, the same laminate is cut into separate individual pieces. After the separate individual pieces are calcined, the external electrode is printed by baking.

With respect to the dielectric laminated resonator made by the manufacturing steps as described above, details are explained.

Figure 30:
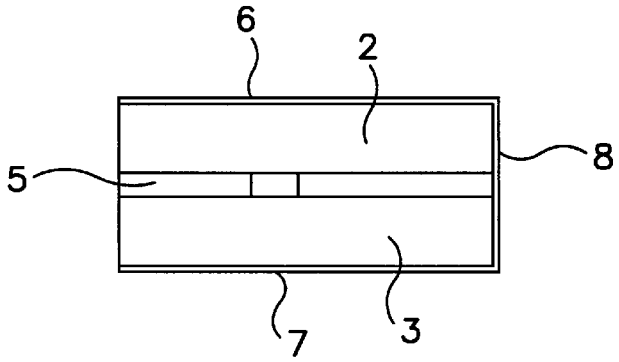
FIG. 30 is a sectional view of a plane including the line X–X' in FIG. 28.

In FIG. 28, FIG. 29 and FIG. 30, the structures are the same as those shown in the first embodiment excepting the following point. The difference is that, the first dielectric sheet 1 has a rectangular parallelepiped opening 331 made by punching out with a puncher or a punching mold, and said opening 331 is formed to the side surface of the first dielectric sheet 1 in a manner to be bent at an orthogonal direction to the opening 4, with an electrode material such as a silver paste or a metal plate imbedded in the opening 331 to form a rectangular parallelepiped input and output line 332, and an end of the input and output line 332 is connected to the strip line 5.

As described above, this embodiment shows the same operation and characteristics as those of the first embodiment. Besides, by forming an input and output line 332, connection with the external circuits can be facilitated, use of the parts such as the input and output fittings can be curtailed, and the substantial mounting area of the dielectric laminated resonator can be reduced, so that a small size module such as dielectric filter can be realized.

Moreover, by extending the input and output line 332 to the lateral side of the first dielectric sheet 1 orthogonally from the strip line 5, the input and output electrode for connecting with an external circuit can be substituted by the other end of the input and output line 332. Accordingly, the number of the processing steps for the external electrode of the dielectric laminated resonator can be curtailed.

Furthermore, because of the use of the other end of the input and output line 332 which is an extra-thick electrode as an input and output electrode, there is less tendency for the defective connection to be caused by collapse of electrode by soldering and the like. Consequently, it is possible to realize a dielectric laminated resonator of good mounting reliability.

Embodiment 9

Hereinafter, the ninth embodiment of the present invention is illustrated with reference to the drawings.

Figure 31:
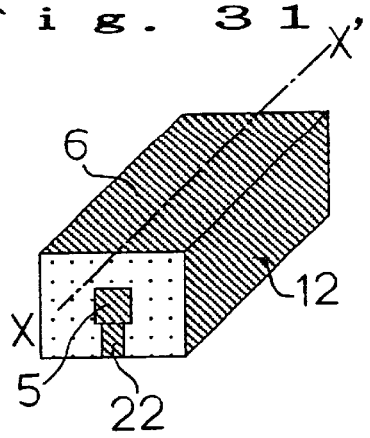
FIG. 31 is a perspective view of a dielectric laminated resonator in the ninth embodiment of the present invention.

FIG. 31 shows a perspective view of a dielectric laminated resonator in the embodiment of the present invention.

Figure 32:
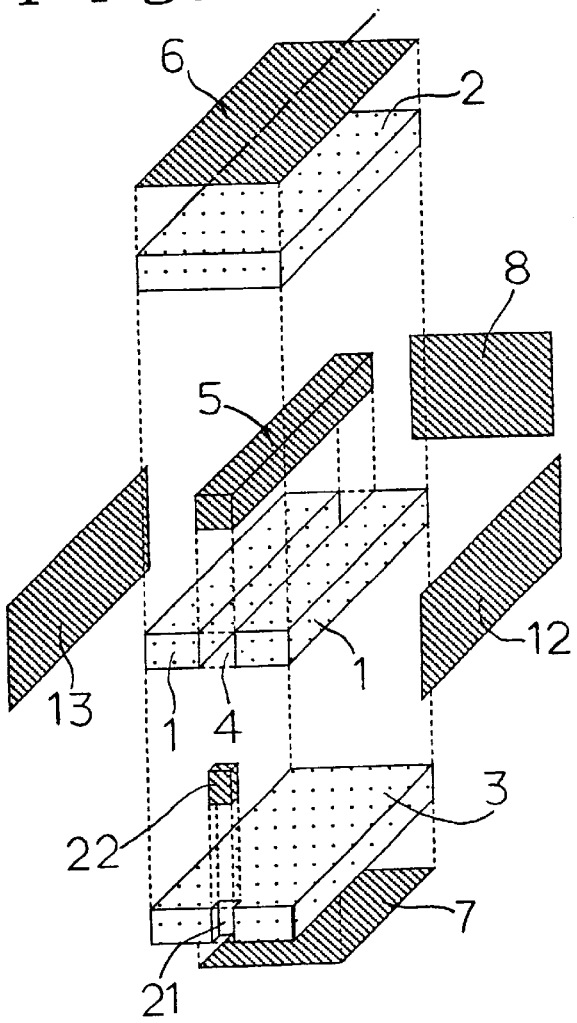
FIG. 32 is a disassembled perspective view of the dielectric laminated resonator in FIG. 31.

FIG. 32 shows a disassembled perspective view in FIG. 31. Further, FIG. 33 shows a sectional view of a plane including the line X–X' in FIG. 31.

With respect to the manufacturing process of the dielectric laminated resonator in the embodiment of the present invention, in the same manner as in the first embodiment, a plurality of dielectric laminated resonators are included in the same laminate, the same laminate is cut into separate individual pieces. After the separate individual pieces are calcined, the external electrode is printed by baking.

With respect to the dielectric laminated resonator made by the manufacturing steps as described above, details are explained.

Figure 33:
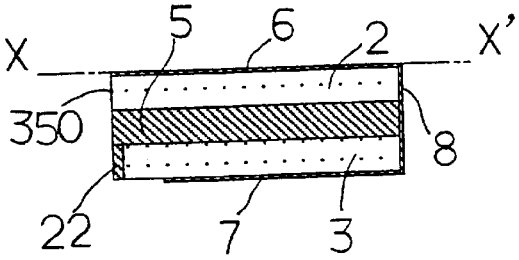
FIG. 33 is a sectional view of a plane including the line X–X' in FIG. 31.

In FIG. 31, FIG. 32 and FIG. 33, the structures are the same as those shown in the second embodiment excepting the following point. The difference is in the point that a recess (through hole) 21 is provided on the lateral side (open end side) of the third dielectric sheet 3, the lateral side of the through hole electrode 22 is exposed to the open end face 350 of the dielectric laminated resonator, and the input and output electrode for connecting with an external circuit is substituted by the other end of the through hole electrode 22. The recess 21 corresponds to the imbedding space for imbedding the electric conductive material of the present invention.

As described above, this embodiment shows the same operation and characteristics as those of the second embodiment. Besides, by substituting the other end of the through hole electrode 22 for an input and output electrode for connecting with the external circuit, the number of steps for processing the external electrode for the dielectric laminated resonator can be curtailed.

Also, in case of mounting a dielectric laminated resonator by means of such as reflow soldering by exposing the lateral side of the through hole electrode 22 to the open end face 350 of the dielectric laminated resonator, soldering fillet is produced, so that the confirmation of soldering in the input and output electrode is facilitated, and increased soldering strength can be obtained.

Furthermore, because of the use of the other end of the through hole electrode 22 which is an extra-thick electrode as an input and output electrode, there is less tendency for the defective connection to be caused by collapse of electrode by soldering and the like.

Consequently, it is possible to realize a dielectric laminated resonator of good mounting reliability.

Moreover, it is possible to use the dielectric laminated device made by the constitution as described above for the terminal of the wireless communication device such as a portable telephone. By this application, for example, it is possible to realize miniature size and high performance factor of the dielectric filter which is one of the most important parts of the high frequency parts to be used for the wireless circuit of the portable telephone, and as a result, an effect is displayed to make it possible to reduce size and obtain high performance in the portable telephone and the like.

In one or more of the above embodiments, the burying space in the present invention is an opening or a through hole, but such space is not limited to the exemplified style but may be, for example, a groove or a gap.

According to the dielectric laminated device manufacturing method of the present invention, in one or more of the embodiments given above, plural dielectric devices are manufactured by cutting a laminate, but the method is not limited to it but the dielectric laminated device may be manufactured piece by piece. Even in this case, the same effect as described above is displayed.

Also, in the coupling electrode and the input and output electrode of the present invention, in one or more of the above embodiments, the arrangement is such that the above coupling electrode is provided on one side and the above input and output coupling electrode is provided on the other side, based on the layer which includes the two strip lines. However, the constitution may not be limited to the above but that both of those electrodes may be provided on the same side, based on the layer which includes the above strip lines.

As described above, according to the dielectric laminated device of the invention described in claim 1 or 7, for example, by forming a strip line by burying the electrode in the opening of the dielectric sheet, the thickness of the line of the strip, line can be thickened more than the case of forming by screen printing, so that the concentration of the high frequency current on the lateral side of the strip line can be alleviated.

That is to say, as it is possible to lead the high frequency current nearly uniformly to the lateral side of the strip line, there can be realized an effect of lessening the unloaded Q of the dielectric laminated resonator by conduction loss of the strip line. Also, since this is the formation of the input and output electrode on the lateral side of the dielectric laminated resonator, it is possible to connect the resonator easily to an external circuit without deteriorating the electric characteristic of the dielectric laminated resonator, and to improve the reliability in mounting such as reflow.

Moreover, according to the dielectric laminated device of the invention described in claim 4, 9 or 10, for example, there are effects such that the unloaded Q of the dielectric laminated resonator is improved, and there is an SIR structure wherein the impedance of the dielectric laminated resonator varies stepwise halfway to show lower resonance frequency, so that the length of the resonator can be shortened.

Furthermore, according to the dielectric laminated device of the invention described in claim 11, for example, there is an effect that the unloaded Q can be further improved by bringing the section of the strip line near the cross shape.

According to the dielectric laminated device of the invention described in claim 12 or 14, for example, there are effects such that the electromagnetic field distribution of the strip line can be made uniform in a vertical direction, and deterioration of unloaded Q of the dielectric laminated resonator by the conduction loss of the strip line can be further lessened.

Furthermore, according to the dielectric laminated device of the invention described in claim 15, for example, there are effects such that almost perfect shield property is obtainable, and deterioration of unloaded Q by radiation loss of the high frequency current can be almost nullified.

In addition, according to the dielectric laminated device of the invention described in claim 13, for example, there is an effect that the sectional shape of the strip line can be made nearly circular and the conduction loss can be further reduced.

Further, according to the dielectric laminated device of the invention described in claim 9 or 11, for example, there is an effect that, by forming the line widths of the second strip line and the third strip line to be the same, the electromagnetic field distribution in the dielectric laminated resonator can be made uniform, so that the dielectric loss can be reduced.

Moreover, according to the dielectric laminated device of the invention described in claim 17, for example, there is an effect that, the impedance of the dielectric laminated resonator is largely changed stepwise halfway, by which the resonance frequency is further lowered, and the length of the resonator can be further shortened.

Also, according to the dielectric laminated filter of the invention described in claim 5 or 18, for example, by forming a strip line by burying an electrode in the opening of the dielectric sheet, the line thickness of the strip line can be made thicker than that formed by the screen printing, so that the electromagnetic field bonding between the strip lines can be made stronger, and a filter of wide band can be realized. Furthermore, by forming a strip line on the dielectric sheet, no irregularity of level is formed, i.e., the dielectric sheet face can be made flat, so that the collapse of the edges on the lateral sides of the strip line formed by pressing the laminate can be evaded, and the distance between the strip lines can be realized in good precision, with the result that the stabilized filter characteristics can be realized. Furthermore, as it is possible to lead the high frequency current almost uniformly on the lateral side of the strip line, deterioration of unloaded Q of the dielectric laminate resonator by the conduction loss of the strip line can be reduced, and as a result, miniature sized high performance dielectric laminated filter can be realized.

What is claimed is:

1. A dielectric laminated filter comprising:

a first dielectric sheet having a plurality of openings formed therein, a plurality of strip lines embedded in said plurality of openings, each strip line being thicker in cross section than a thickness of a cross section formed by screen printing to reduce deterioration of an unloaded Q of the dielectric laminated filter due to a conduction loss, a second dielectric sheet laminated over a first surface of said first dielectric sheet, a third dielectric sheet laminated over a second surface of said first dielectric sheet, a coupling electrode internally laminated in said second dielectric sheet, for forming a coupling capacity with said plurality of strip lines, an input and output coupling electrode internally laminated in said third dielectric sheet, for forming an input and output capacity with said plurality of strip lines, a first shield electrode disposed over an upper surface of said second dielectric sheet, and a second shield electrode disposed over a lower surface of said third dielectric sheet, wherein a first end surface of each of said plurality of strip lines is coupled to a ground electrode, a second end surface of each of said plurality of strip lines is open, and said first, second and third dielectric sheets are calcined into a unitary piece.

2. A mobile communication apparatus characterized by using a dielectric laminated device according to claim 1.

* * * * *